US010935213B2

(12) United States Patent
Morino et al.

(10) Patent No.: US 10,935,213 B2
(45) Date of Patent: Mar. 2, 2021

(54) ILLUMINATION DEVICE

(71) Applicants: KABUSHIKI KAISHA TOSHIBA, Minato-ku (JP); TOSHIBA MATERIALS CO., LTD., Yokohama (JP)

(72) Inventors: Takeshi Morino, Yokohama (JP); Hiroshi Ohno, Tokyo (JP)

(73) Assignees: KABUSHIKI KAISHA TOSHIBA, Minato-ku (JP); TOSHIBA MATERIALS CO., LTD., Yokohama (JP)

( * ) Notice: Subject to any disclaimer, the term of this patent is extended or adjusted under 35 U.S.C. 154(b) by 16 days.

(21) Appl. No.: 16/515,280

(22) Filed: Jul. 18, 2019

(65) Prior Publication Data

US 2019/0338916 A1 Nov. 7, 2019

Related U.S. Application Data

(63) Continuation of application No. PCT/JP2018/014806, filed on Apr. 6, 2018.

(30) Foreign Application Priority Data

Apr. 7, 2017 (JP) ..... JP2017-076949

(51) Int. Cl.
*F21V 7/00* (2006.01)
*F21V 7/06* (2006.01)
*F21Y 115/10* (2016.01)

(52) U.S. Cl.
CPC ..... *F21V 7/0083* (2013.01); *F21V 7/0066* (2013.01); *F21V 7/06* (2013.01); *F21Y 2115/10* (2016.08)

(58) Field of Classification Search
CPC .... F21V 7/0008; F21V 7/0066; F21V 7/0083; F21V 7/09; F21Y 2105/14
See application file for complete search history.

(56) References Cited

U.S. PATENT DOCUMENTS 5,580,156 A * 12/1996 Suzuki ..... B60Q 7/00 116/63 P
6,443,594 B1 * 9/2002 Marshall ..... F21V 5/007 362/244

(Continued)

FOREIGN PATENT DOCUMENTS

JP 2012-81057 4/2012
JP 2013-211098 10/2013

(Continued)

OTHER PUBLICATIONS

International Search Report dated Jun. 26, 2018 in PCT/JP2018/014806 filed Apr. 6, 2018 (with English translation).

(Continued)

*Primary Examiner* — Julie A Bannan
(74) *Attorney, Agent, or Firm* — Oblon, McClelland, Maier & Neustadt, L.L.P.

(57) ABSTRACT

According to one embodiment, an illumination device includes a plurality of light emitting elements and a plurality of reflectors. The plurality of reflectors include at least one first reflector and at least one second reflector. The first reflector is provided corresponding to the first region at the center and is provided so that the corresponding light emitting element is positioned within a focal region in the vicinity of a focal point. The second reflector is provided corresponding to the second region, has an angular eccentricity so as to collect light on one region on the optical axis, and is provided so as to be positioned within a margin region in which one of the corresponding light emitting elements is (Continued)

provided at a position farther away than a second focal region in the vicinity of the focal point.

11 Claims, 22 Drawing Sheets

(56) References Cited

U.S. PATENT DOCUMENTS

| | | | | |
|---|---|---|---|---|
| 7,246,921 | B2 * | 7/2007 | Jacobson | H01L 33/642 362/294 |
| 8,079,737 | B2 * | 12/2011 | Wang | F21V 7/048 362/306 |
| 9,335,018 | B2 * | 5/2016 | Han | F21S 41/151 |
| 9,709,239 | B2 * | 7/2017 | Weekamp | F21V 7/18 |
| 9,741,700 | B2 * | 8/2017 | Kim | H01L 25/0753 |
| 2002/0136025 | A1 * | 9/2002 | Zhang | F21V 29/74 362/555 |
| 2007/0217193 | A1 * | 9/2007 | Lin | F21V 7/09 362/245 |
| 2018/0238518 | A1 * | 8/2018 | Huang | F21V 7/08 |
| 2019/0063723 | A1 * | 2/2019 | Yamada | H01L 33/0075 |

FOREIGN PATENT DOCUMENTS

| | | |
|---|---|---|
| JP | 5483252 | 5/2014 |
| JP | 2015-173053 | 10/2015 |
| JP | 2016-24971 | 2/2016 |
| JP | 2017-16900 | 1/2017 |

OTHER PUBLICATIONS

Written Opinion dated Jun. 26, 2018 in PCT/JP2018/014806 filed Apr. 6, 2018.

* cited by examiner

ILLUMINATION DEVICE

CROSS-REFERENCE TO RELATED APPLICATION

This application is a Continuation Application of PCT Application No. PCT/JP2018/014806, filed Apr. 6, 2018, and based upon and claiming the benefit of priority from prior Japanese Patent Application No. 2017-076949, filed Apr. 7, 2017, the entire contents of all of which are incorporated herein by reference.

FIELD

Embodiments described herein relate generally to an illumination device capable of illuminating an object with light.

BACKGROUND

There are LED illumination devices that can be used for dental treatment. Such an LED illumination device is often configured to secure necessary illuminance by using a plurality of light emitting elements.

BRIEF DESCRIPTION OF THE DRAWINGS

FIG. 15 is a schematic view illustrating a model for evaluating the convergence of light by using the illumination unit illustrated in FIG. 14 and schematically illustrating a positional relationship between a screen, a light emitting element, and the like.

DETAILED DESCRIPTION

According to one embodiment, an illumination device of an embodiment includes: a plurality of light emitting elements provided on a surface intersecting with an optical axis; and a plurality of reflectors provided so as to correspond to the plurality of light emitting elements, each of the plurality of reflectors having a curved cross section with at least one focal point. The plurality of reflectors includes: at least one first reflector provided corresponding to a central first region corresponding to the optical axis on the surface intersecting with the optical axis, the at least one first reflector being provided so that one of the plurality of corresponding light emitting elements are positioned within a focal region in the vicinity of the focal point; and at least one second reflector provided corresponding to a second region positioned on the surface intersecting with the optical axis that is deviated from the first region in a direction intersecting with the optical axis, the at least one second reflector having an angular eccentricity so as to collect light on one region on the optical axis and being provided so as to be positioned within a margin region in which one of the plurality of corresponding light emitting elements are provided at positions farther away than a second focal region in the vicinity of the focal point.

First Embodiment

Hereinafter, a first embodiment of an illumination device will be described with reference to FIGS. 1 to 21. Although the illumination device 11 is mainly used for dental treatment, it can naturally be applied to other medical applications or desk lamps. The illumination device 11 includes a pair of illumination units 12 (light emitting element array).

Figure 1:
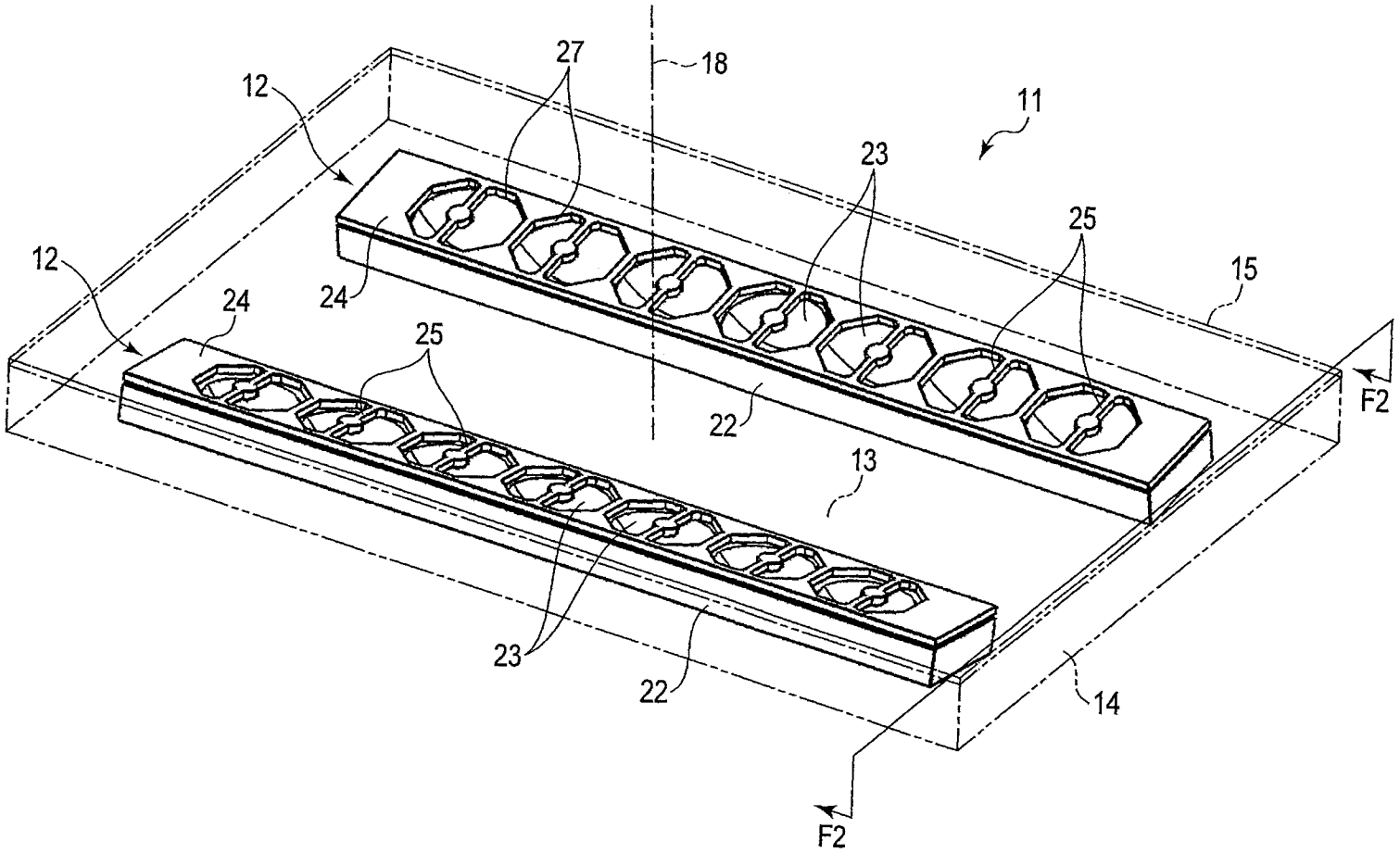
FIG. 1 is a perspective view of an illumination device according to a first embodiment.
Figure 2:
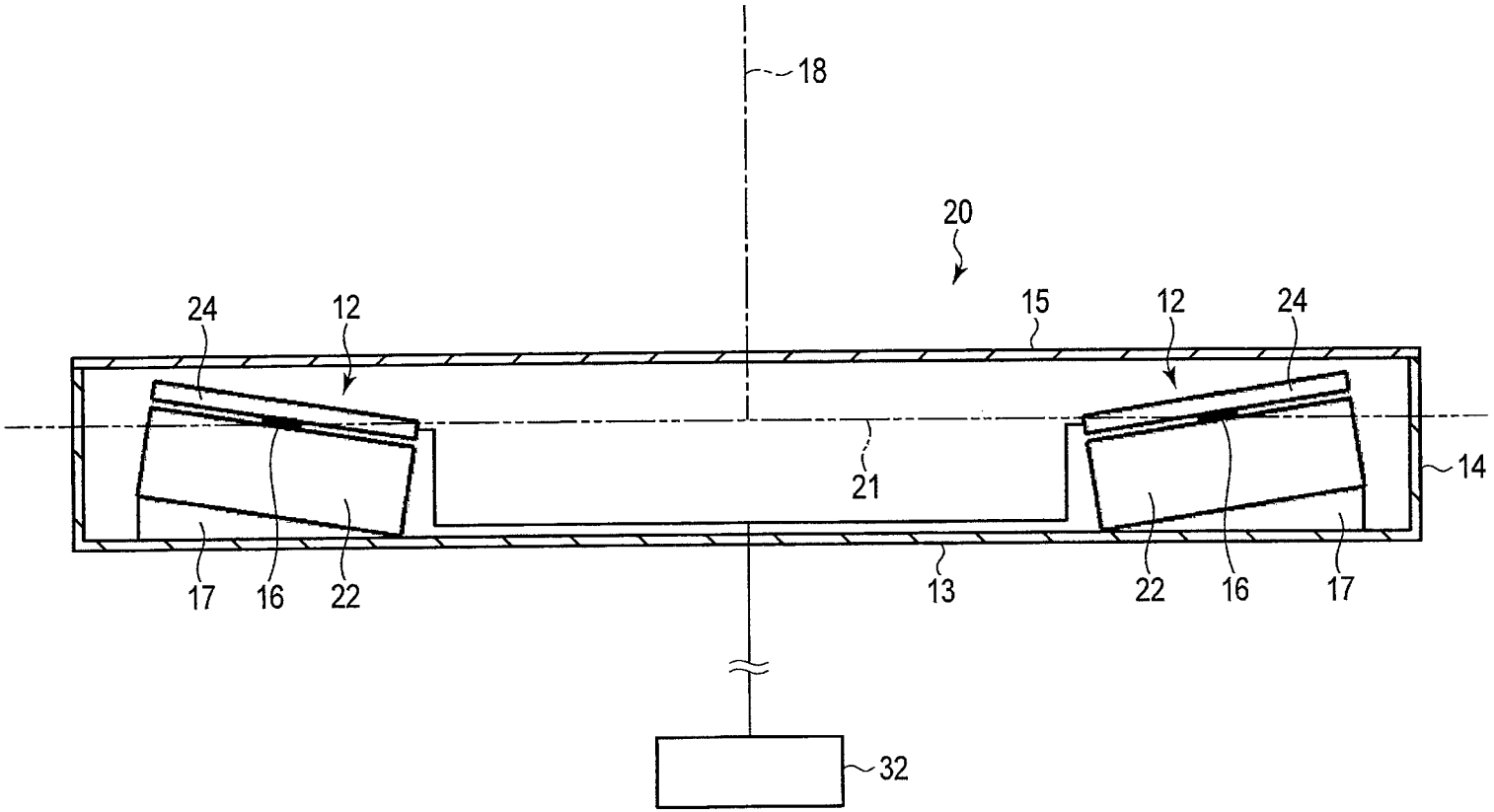
FIG. 2 is a cross-sectional view illustrating the interior of the illumination device by cutting a support body, a lamp shade portion, and a cover along line F2-F2 illustrated in FIG. 1.
Figure 3:
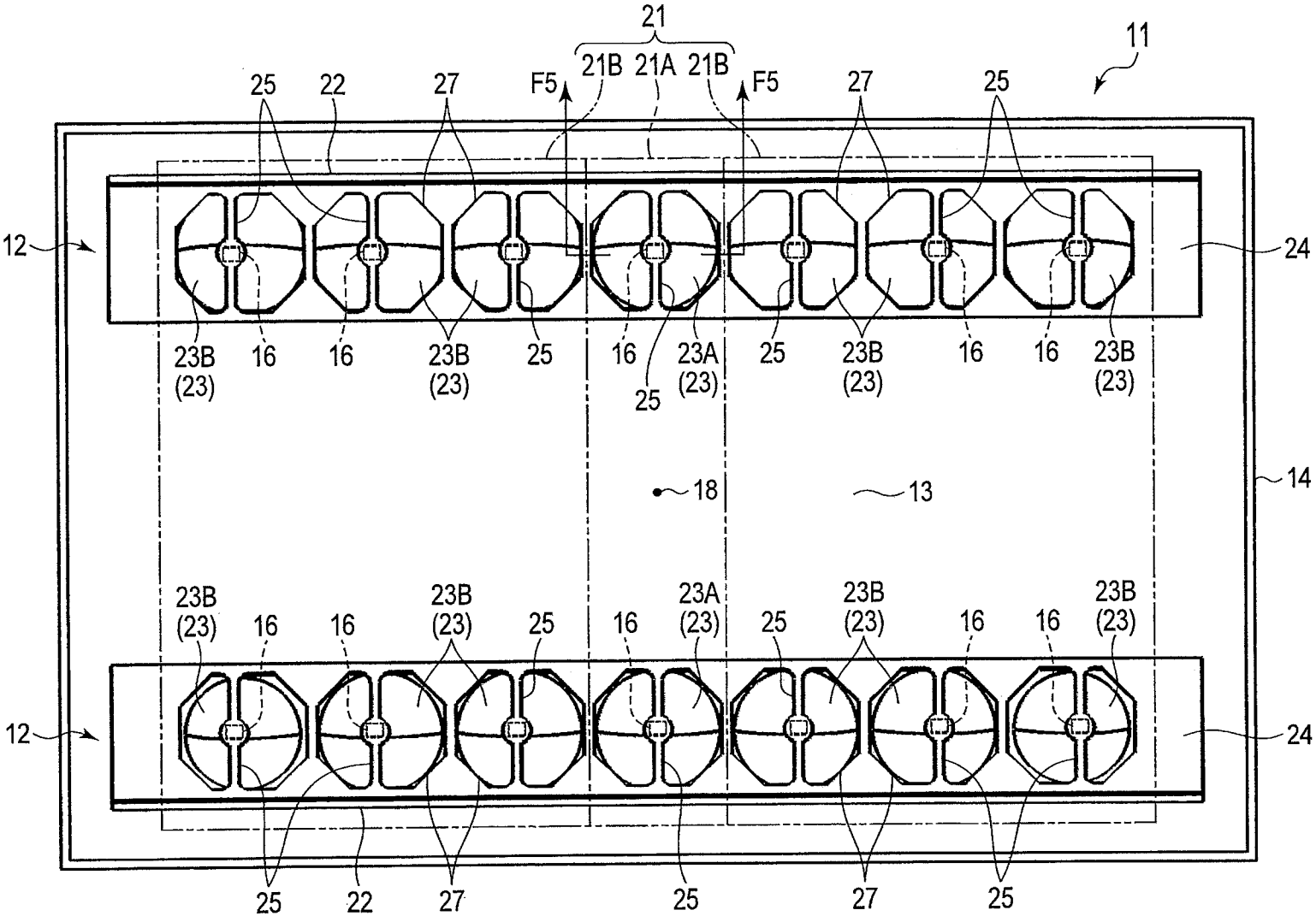
FIG. 3 is a front view of the illumination device illustrated in FIG. 1.

As illustrated in FIGS. 1 to 3, the illumination device 11 includes a support body 13, a lamp shade portion 14 provided in a frame shape so as to be continuous with the support body 13, a transmissive cover 15 provided so as to cover a distal end portion of the lamp shade portion 14 (end portion on the opposite side to an end portion on the support body 13 side), and a pair of illumination units 12 (array of light emitting elements 16) fixed to the support body 13 through leg portions 17 or the like. The support body 13 is supported by an arm or the like. For example, the support body 13 can be supported at a predetermined position and angle through the arm so as to face a patient. The leg portion 17 has, for example, a triangular cross-sectional shape. An optical axis 18 (illumination optical axis) of the illumination device 11 as a whole is defined by a set of light irradiated from a plurality of light emitting elements 16 described later. The optical axis 18 (illumination optical axis) passes through the center of the support body 13 and coincides with the central axis intersecting with (orthogonal to) the support body 13.

Further, as illustrated in FIGS. 2 and 3, a surface 21 (light emitting surface) intersecting with the optical axis can be defined in the illumination device 11. An example of the surface 21 intersecting with the optical axis can be a surface orthogonal to the optical axis 18, but the present embodiment is not limited thereto. Another example of the surface 21 intersecting with the optical axis may be a surface substantially orthogonal to the optical axis 18.

The surface 21 intersecting with the optical axis has a first region 21A at the center corresponding to the optical axis 18 and a second region 21B deviating from the first region 21A in a direction intersecting with the optical axis 18. In the present embodiment, an example of the direction intersecting with the optical axis 18 is a horizontal direction (transverse direction), but the present embodiment is not limited thereto. It is obvious that the direction intersecting with the optical axis 18 may be, for example, a vertical direction (longitudinal direction).

As illustrated in FIGS. 1 to 3, the illumination unit 12 includes a mirror block 22 having a plurality of reflectors 23 formed thereon, a substrate 24 provided so as to face the mirror block 22 and the plurality of reflectors 23, and a plurality of light emitting elements 16 (light source) provided on a plurality of support portions 25 of the substrate 24 described later.

The plurality of light emitting elements 16 are linearly provided at substantially constant intervals on the surface 21 (light emitting surface) intersecting with the optical axis, for example, in the direction intersecting with the optical axis 18 (for example, the horizontal direction). Each of the plurality of light emitting elements 16 includes, for example, a white LED, but may include LEDs of other colors. In addition, the colors of some light emitting elements 16 included in the plurality of light emitting elements 16 may be different from the colors of the other light emitting elements 16 included in the plurality of light emitting elements 16. The light emitting elements 16 may appropriately use commercially available light emitting elements.

The substrate 24 includes a printed wiring board made of a glass epoxy resin or the like. The substrate 24 is a so-called multilayer substrate formed by laminating a plurality of wiring layers. The substrate 24 has an elongated plate shape. The substrate 24 may be provided so as to cover the mirror block 22. The substrate 24 includes a substrate body 26, a plurality of opening portions 27 provided in the substrate body 26, and a plurality of support portions 25 provided in the substrate body 26. The plurality of opening portions 27 is linearly disposed along the extending direction of the substrate 24. Each of the plurality of support portions 25 is positioned inside each of the plurality of opening portions 27. Each of the plurality of support portions 25 is provided so as to correspond to each of the plurality of reflectors 23.

Figure 4:
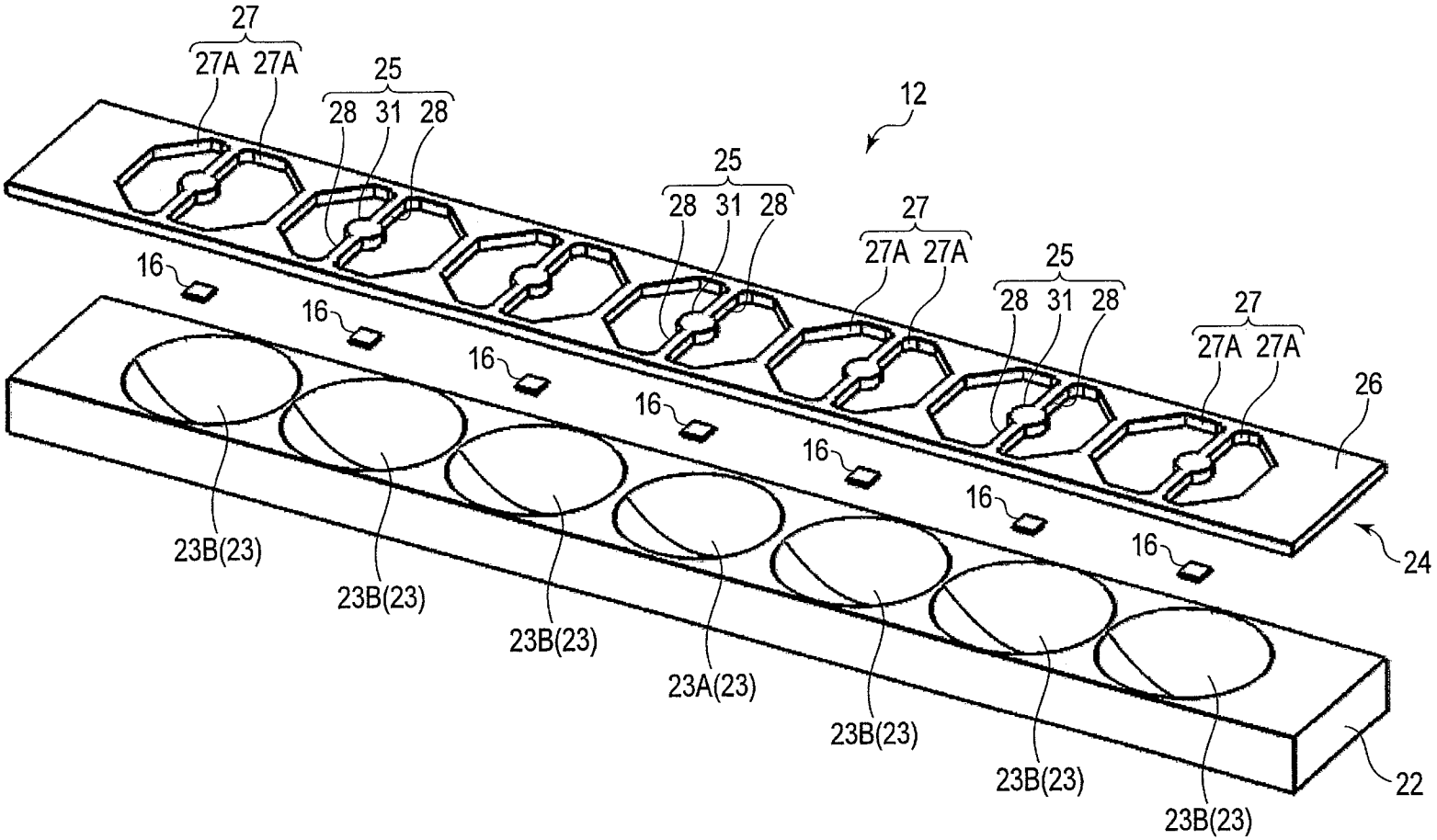
FIG. 4 is an exploded perspective view of one of illumination units of the illumination device illustrated in FIG. 1.
Figure 5:
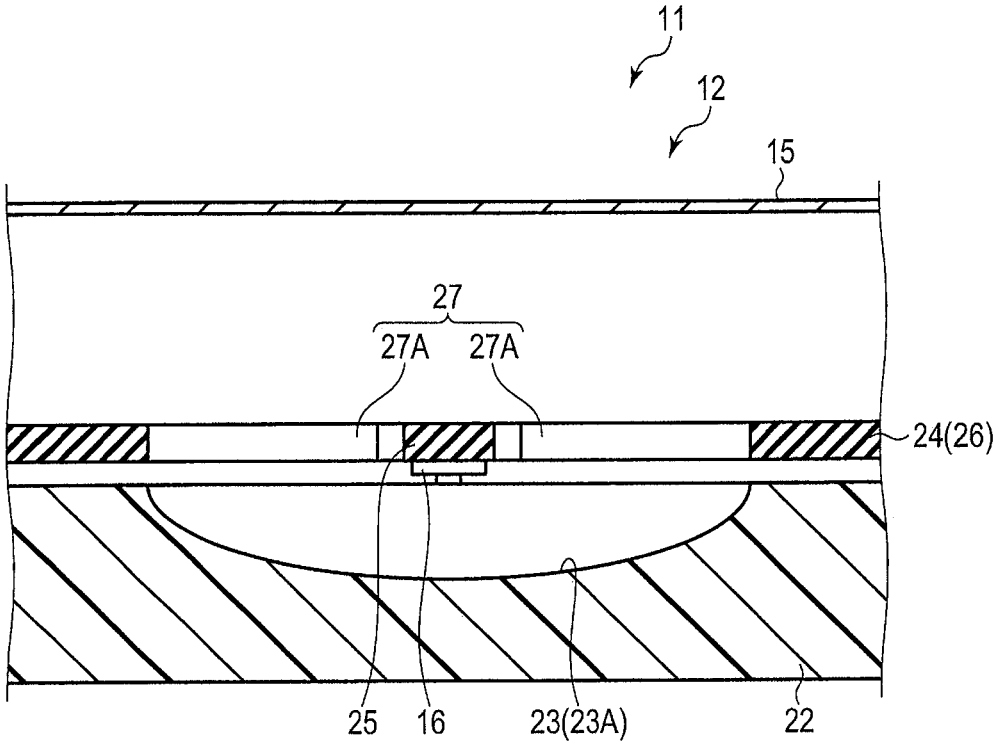
FIG. 5 is a cross-sectional view taken along line F5-F5 illustrated in FIG. 3.

As illustrated in FIGS. 4 and 5, the opening portion 27 has a pair of through-hole portions 27A passing through a front surface and a back surface of the substrate 24. The pair of through-hole portions 27A is provided on both sides with the support portion 25 interposed therebetween. The opening portion 27 has, for example, an approximately octagonal shape, and may have other polygonal shapes. The opening portion 27 is provided so as to expose the plurality of reflectors 23 of the mirror block 22 to the outside, which will be described later. Therefore, each of the plurality of opening portions 27 is provided so as to correspond to each of the plurality of reflectors 23.

As illustrated in FIGS. 3 and 4, each of the plurality of support portions 25 is formed in a bridge shape passing through the opening portion 27. The support portion 25 includes a bridge portion 28 and a placement portion 31 provided at the middle of the bridge portion 28. One light emitting element 16 is mounted on the placement portion 31. The placement portion 31 has, for example, a circular shape and is provided in the middle of the bridge portion 28. The light emitting element 16 receives supply of power from a power supply 32 through wirings provided in the bridge portion 28.

The support portion 25 at the position corresponding to the first region 21A is provided so as to be positioned at the center of the first reflector 23A corresponding thereto, which will be described later. The support portion 25 at the position corresponding to the second region 21B is provided so as to be position-deviated in the direction away from the first region 21A with respect to the center of the second reflector 23B corresponding thereto. The magnitude of the positional deviation changes according to the position from the first region 21A. More specifically, the magnitude of the positional deviation of the support portion 25 in the direction away from the first region 21A increases as the position of the support portion 25 moves away from the first region 21A (the center of the illumination device 11). That is, the magnitude of the positional deviation of the support portion 25 positioned in the vicinity of the first region 21A among the support portions 25 at positions corresponding to the second region 21B is relatively small as compared with that of the center of the second reflector 23B corresponding thereto (positional deviation in the direction away from the first region 21A). In addition, the magnitude of the positional deviation of the support portion 25 positioned at the position away from the first region 21A among the support portions 25 positioned in the second region 21B is relatively large as compared with that of the center of the second reflector 23B corresponding thereto (positional deviation in the direction away from the first region 21A).

The mirror block 22 is formed in, for example, an elongated plate shape by a resin material or the like. The mirror block 22 includes the plurality of reflectors 23. The plurality of reflectors 23 are provided so as to correspond to the plurality of light emitting elements 16. The plurality of reflectors 23 are linearly provided at one side of the mirror block 22, for example, at substantially constant intervals. Each of the plurality of reflectors 23 is provided in a substantially semispherical shape recessed from one surface.

The mirror block 22 can be formed by, for example, the following method. Machining (for example, cutting work) is performed from one surface side of a plate material on an elongated plate material made of a resin material to form a semispherical surface on the one surface. The plurality of reflectors 23 can be formed on the mirror block 22 by forming a mirror layer on the spherical surface by various thin film forming methods such as vapor deposition or electroless plating.

The plurality of reflectors 23 includes at least one first reflector 23A and at least one second reflector 23E. The at least one first reflector 23A is provided corresponding to the central first region 21A corresponding to the optical axis 18. In the present embodiment, for example, the first reflector 23A is constituted by one piece, but it is obvious that the first reflector 23A may be constituted by a plurality of pieces. The first reflector 23A faces the light emitting element 16 positioned in the first region 21A. A cross section of the first reflector 23A forms, for example, a curve, and more specifically, forms a quadratic curve. A cross section of the curve of the first reflector 23A is, for example, parabolic, but the shape of the cross section of the curve of the first reflector 23A is not limited thereto. The cross-sectional shape of the curve of the first reflector 23A may be a shape of a quadratic curve other than a parabola, for example, a hyperbolic shape or an elliptical shape. In the case where the cross section of the curve of the first reflector 23A is formed by a parabola or a hyperbola, it has one focal point 33. In the case where the cross section of the curve of the first reflector 23A is formed in an elliptical shape, it has two focal points 33. A distance from the apex 34 of the curve to the focal point 33 can be determined mathematically by a known mathematical formula.

As illustrated in FIGS. 3 and 4, the at least one second reflector 23B is provided corresponding to the second region 21B positioned away from the first region 21A in a direction intersecting with (orthogonal to) the optical axis 18. In the present embodiment, for example, the second reflector 23B is constituted by a plurality of pieces. Each of the plurality of second reflectors 23B faces each of the plurality of light emitting elements 16 positioned in the second region 21B. Each of the second reflectors 23B has a curved cross section, and the curve has, for example, a quadratic curve shape. A cross section of the curve of the second reflector 23B is formed, for example, in a parabolic shape. However, the axis of the curve (parabola) of the second reflector 23B is inclined with respect to the optical axis 18 so as to collect light toward one region 35 (see FIG. 15) on the optical axis 18 (illumination optical axis). More specifically, the axis of the curve of the second reflector 23B, that is, the optical axis (individual optical axis 36) of each light emitting element is inclined so as to approach the optical axis 18 (illumination optical axis) as the distance from the illumination device 11 increases. The inclination of the axis of the curve of the second reflector 23B is different from the inclination of the axis of the curve of another adjacent second reflector 23B. That is, the inclination of the axis of the curve of the second reflector 23B is larger as the distance from the central first region 21A corresponding to the optical axis 18 increases.

The shape of the cross section of the curve of the second reflector 23B is not limited to the parabolic shape. The shape of the cross section of the curve of the second reflector 23B may be a shape of a quadratic curve other than a parabola, for example, a hyperbolic shape or an elliptical shape. In the case where the cross section of the curve of the first reflector 23A is formed by a parabola or a hyperbola, it has one focal point 33. In the case where the cross section of the curve of the first reflector 23A is formed in an elliptical shape, it has two focal points 33. A distance from the apex 34 of the curve to the focal point 33 can be determined mathematically by a known mathematical formula.

Figure 6:
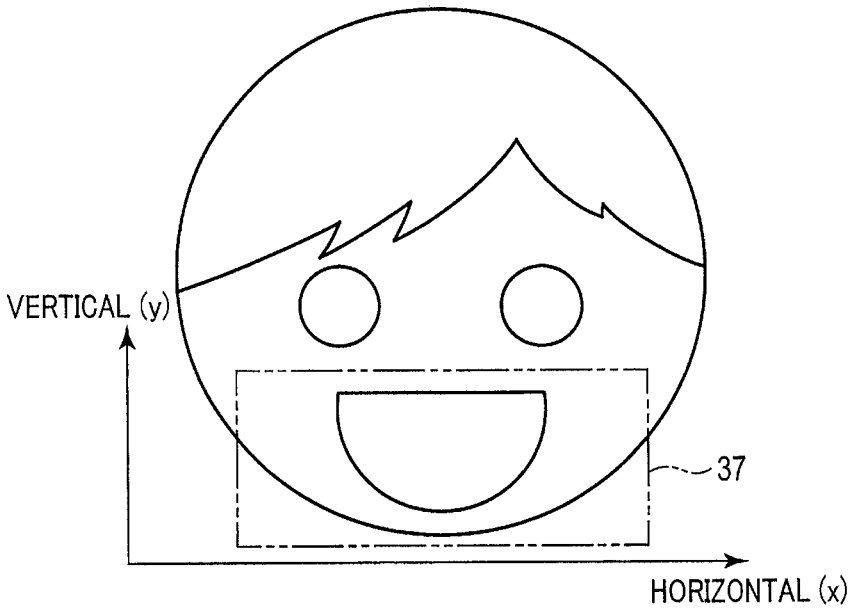
FIG. 6 is a schematic view schematically illustrating a state of illuminating an oral cavity of a patient with light by using the illumination device of the embodiment.

Here, as illustrated in FIG. 6, an attempt was made to arrange the plurality of reflectors 23 and the light emitting elements 16, such that an irradiation pattern which remarkably suppressed illuminance could be obtained at a position deviated from the illumination target region 37, while collecting light from the plurality of light emitting elements 16 to obtain sufficient illuminance with respect to the illumination target region 37 around the oral cavity of the patient. It is also required by Japanese Industrial Standards (JIS) (JIS T5753: 2012 dental illuminator) to extremely lower illuminance at a position deviated from the illumination target region 37, especially at the eye position of the patient. Note that JIS T5753 corresponds to ISO 9680:2014, Dentistry-Operating lights (MOD). In order to reduce the burden on the patient's eyes, intensive studies were carried out to the realization of the illumination device 11 with excellent irradiation pattern cutoff characteristics such that light does not reach the patient's eyes.

First, it was examined at which position of the illumination unit 12 (light emitting element array) the light emitting element 16 most affects the convergence of light of the illumination device 11 as a whole. The convergence of light (degree of convergence) is an important parameter to consider so as not to illuminate the position of the patient's eyes. The result is omitted, but in the light emitting element array, the light emitted from the light emitting element 16 and the first reflector 23A positioned at the center did not particularly adversely affect the convergence of light of the entire illumination device 11. On the other hand, in the light emitting element array, blurring (blurring like defocusing, coma aberration) over which the irradiation pattern protrudes from the illumination target region 37 is remarkable in the light emitted from the light emitting element 16 and the second reflector 23B at a position away from the central first region 21A (position close to the end portion). Therefore, it was found that the improvement of the convergence of the light emitted from the light emitting element 16 and the second reflector 23B positioned in the vicinity of the end portion as described above was important for improving the convergence of light of the illumination device 11 as a whole.

Figure 7:
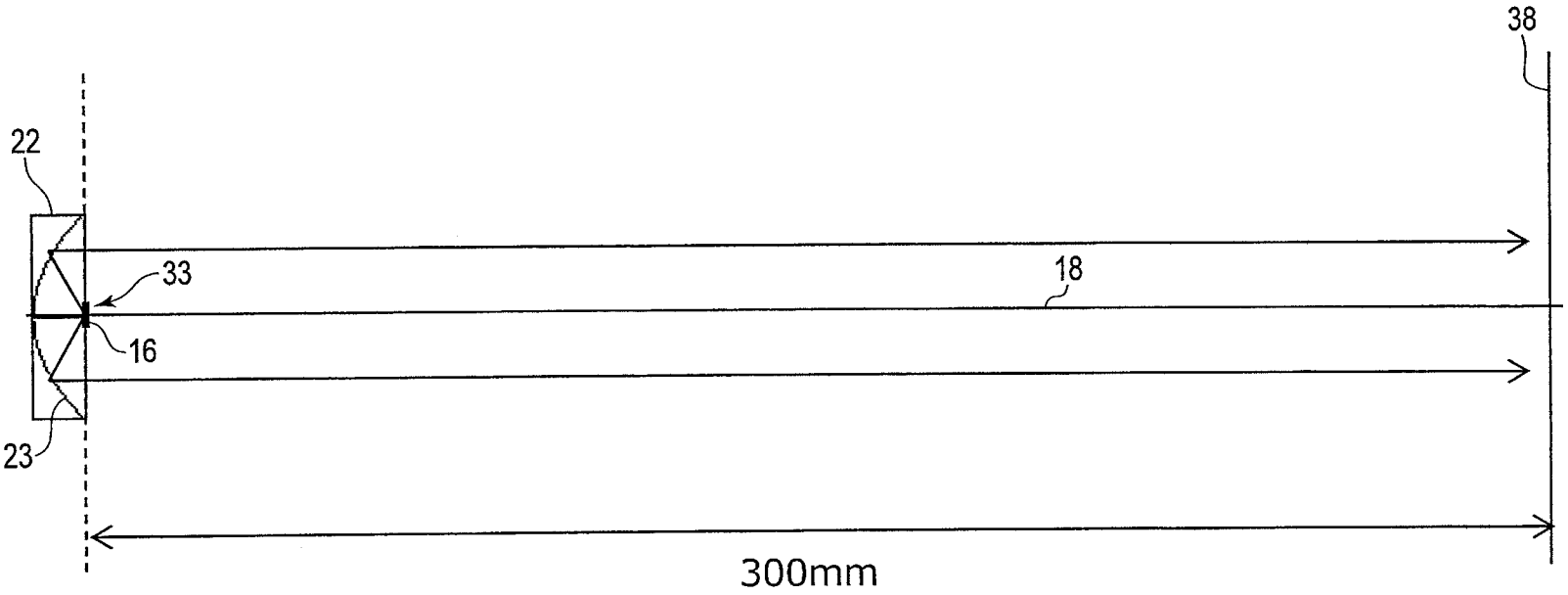
FIG. 7 is a schematic diagram illustrating a simulation model using a light emitting element and a parabolic reflector.

Subsequently, a theoretical analysis was performed on the convergence of the light emitted from the light emitting element 16 by using the simplified model illustrated in FIG. 7. The reflector 23 was formed with a parabolic surface such that the cross-sectional shape of the reflector 23 became a parabola. For example, $z=0.025\times(x^2+y^2)+C$ was used as the mathematical formula of the parabolic surface of the reflector 23. The light emitting element 16 was disposed in the vicinity of the focal point 33 of the parabola of the reflector 23. In addition, a screen 38 on which light was irradiated was installed at a position 300 mm away from the light emitting element 16 (reflector 23). In this model, the light emitted from the light emitting element 16 is reflected by the reflector 23 and irradiated in the direction of the optical axis 18. Using this model, the influence of the distance between the reflector 23 and the light emitting element 16 on the convergence of light (illuminance distribution) was studied.

Figure 8:
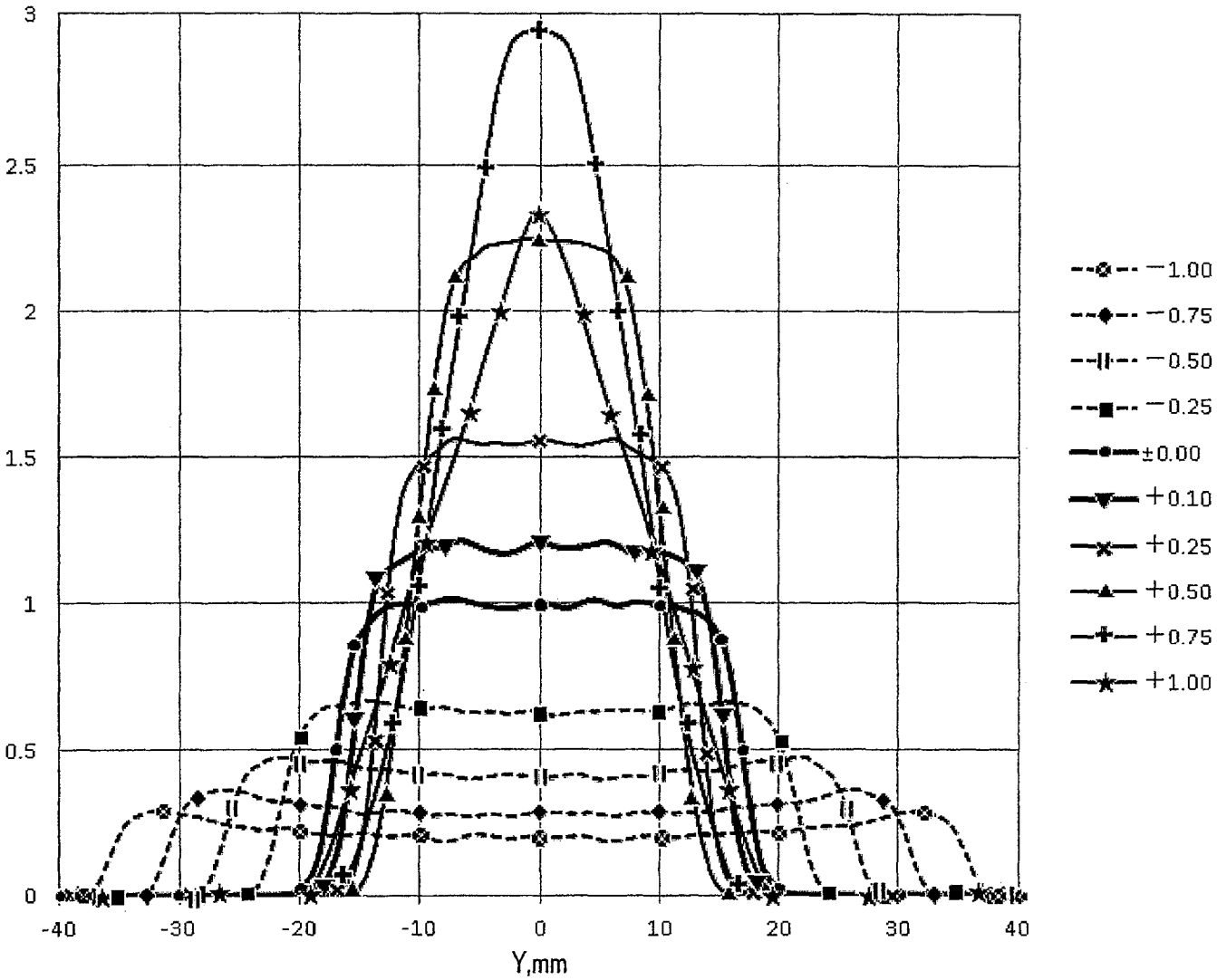
FIG. 8 is a graph illustrating the convergence of light reflected by the parabolic reflector when the position of the light emitting element is deviated in a direction approaching the apex of the paraboloid and a direction away from the apex of the paraboloid with reference to the focal point of the paraboloid by using the model illustrated in FIG. 7.

The examination results are shown in FIG. 8. The horizontal axis Y represents the distance (mm) from the center of light (optical axis 18). The vertical axis represents the normalized illuminance. The case where the light emitting element 16 is placed at the position of the focal point 33 is set as ±0.00. The case where the light emitting element 16 was moved in the direction away from the reflector 23 in the direction of the optical axis 18 with the focal point 33 set at the reference (±0.00) was set as plus, and the case where the light emitting element 16 was moved in the direction approaching the reflector 23 in the direction of the optical axis 18 was set as minus. In the direction away from the reflector 23, the position of the light emitting element 16 was moved in the range of 0.10 mm to 1.00 mm. In the direction approaching the reflector 23, the light emitting element 16 was moved in the range of 0.25 mm to 1.0 mm. In this simulation result, the illuminance on the screen 38 when the light emitting element 16 was placed at the focal point 33 was normalized to 1 with respect to the vertical axis.

According to this result, as the light emitting element 16 was moved in the direction away from the reflector 23, the width of the illuminance distribution in the Y axis direction became small, the convergence of the light irradiated from the light emitting element 16 became excellent, and the center illuminance was also high. When the convergence of light becomes excellent as described above, the patient does not feel dazzling, and the intended ideal illumination device 11 is obtained. The center illuminance when the light emitting element 16 was moved by 1.00 mm from the focal point 33 in the direction away from the reflector 23 in the direction of the optical axis 18 was lower than the center illuminance when the light emitting element 16 was moved by 0.75 mm from the focal point 33 in the direction away from the reflector 23 in the direction of the optical axis 18. On the other hand, it was found that when the light emitting element 16 was moved in the direction approaching the reflector 23 in the direction of the optical axis 18, the convergence of the light irradiated from the light emitting element 16 deteriorated.

Figure 9:
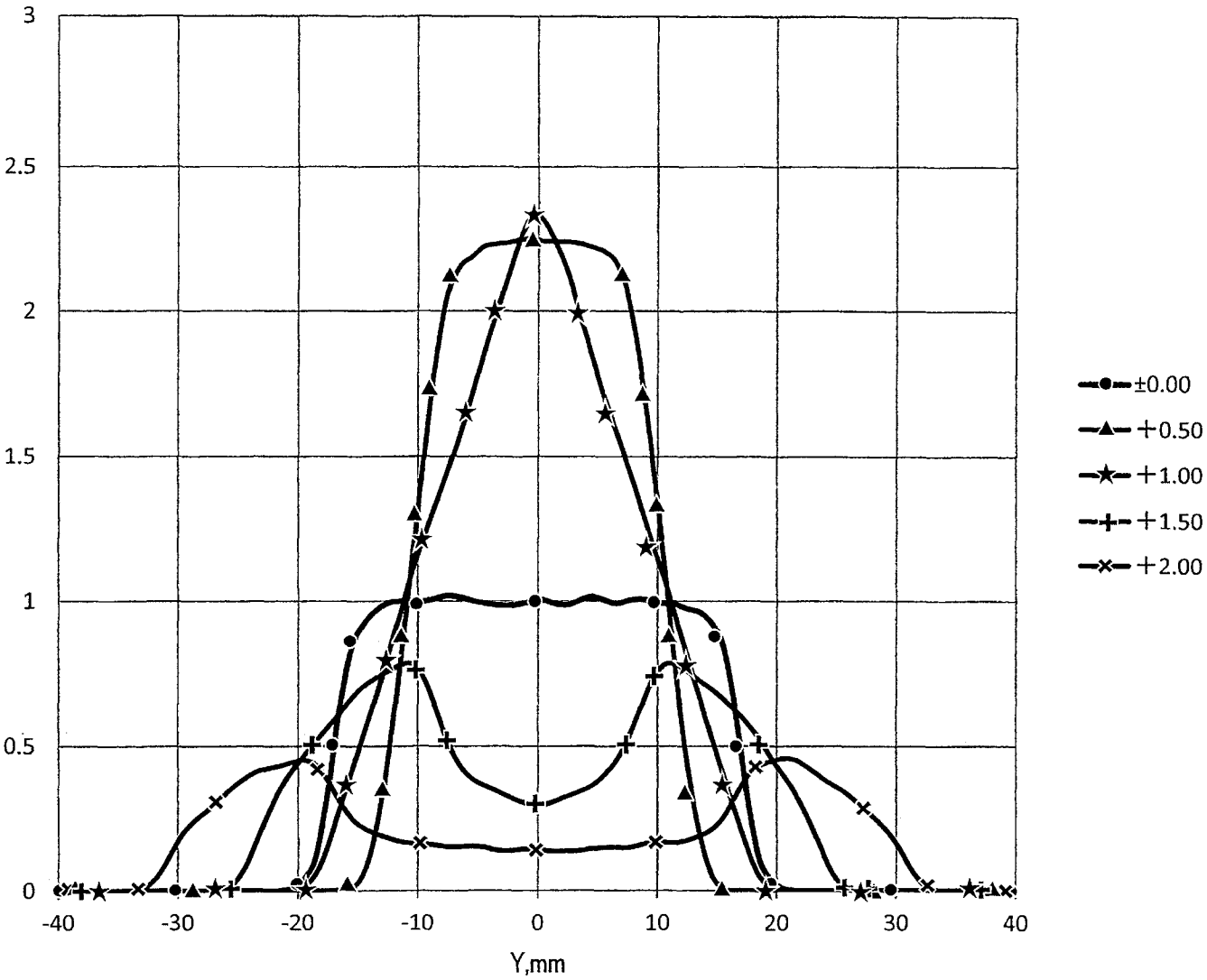
FIG. 9 is a graph illustrating the convergence of light reflected by the parabolic reflector when the position of the light emitting element is deviated in a direction away from the apex of the paraboloid with reference to the focal point of the paraboloid by using the model illustrated in FIG. 7.

FIG. 9 illustrates a simulation result when the light emitting element 16 was moved by a distance larger than 1.00 mm from the focal point 33. For example, it was found that when the light emitting element 16 was moved so as to be away from the focal point 33 by 1.50 mm, the center illuminance of the light decreased. Further, it was found that when the light emitting element 16 was moved away from the focal point 33 by 2.00 mm, the center illuminance of the light further decreased and the convergence of light also deteriorated.

Therefore, from the above simulation result, when the position of the light emitting element 16 was deviated from the focal point 33 in the direction away from the reflector 23 in the direction of the optical axis (individual optical axis 36) of the light emitting element 16 within the range of 0.10 mm to 1.00 mm, it was possible to obtain a suggestion that it was remarkably superior to the result outside this range in the convergence and luminance of light. Therefore, the idea was obtained that the blurring (light diffusion) in which the irradiation pattern protruded from the illumination target region 37 could be efficiently reduced in the light emitting element 16 and the second reflector 23B when the structure for deviating the position of the light emitting element 16 from the focal point 33 as described above was applied with respect to the light emitting element 16 and the second reflector 23B positioned at the position (in the vicinity of the end portion) far from the first region 21A of the array of the light emitting elements 16 (illumination unit 12).

Figure 10:
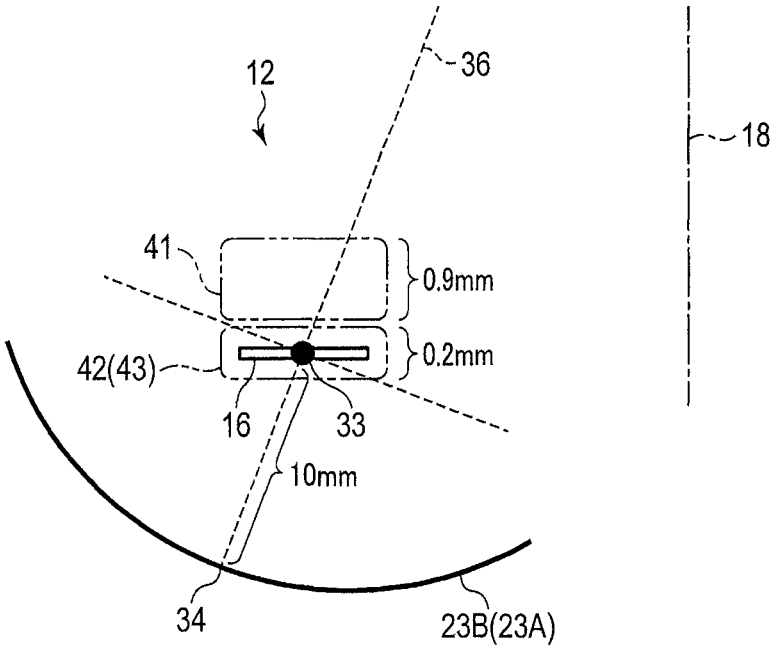
FIG. 10 is a schematic view illustrating a model of a light emitting element and a second reflector in the vicinity of an end portion of a light emitting element array, in which a margin region is set around a focal point from the results illustrated in FIGS. 8 and 9.
Figure 11:
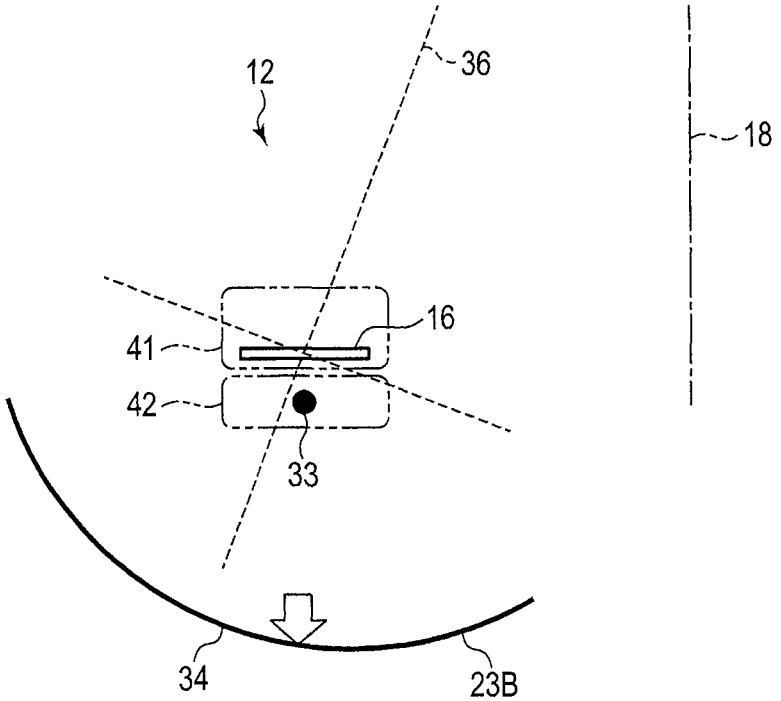
FIG. 11 is a schematic view illustrating a model of a light emitting element and a second reflector in the vicinity of an end portion of a light emitting element array, in which the position of the light emitting element is deviated in the optical axis direction of the illumination device so as to arrange the light emitting element in the margin region of the schematic view illustrated in FIG. 10.

Despite the above suggestion and idea, industrially, deviating the position of the light emitting element 16 in the direction of the optical axis 18 (illumination optical axis) as the entire illumination device 11 as illustrated in FIGS. 10 and 11 is realistic in view of the manufacturing cost and the like rather than deviating the position of the light emitting element 16 in the direction of the optical axis (individual optical axis 36) of each light emitting element 16. Therefore, in the present embodiment, in consideration of the suggestion of the range in which the convergence and illuminance of light were remarkably excellent as described above, the region between a point where a distance equivalent to 1% of the distance from the apex 34 of the curve of the second reflector 23B to the focal point 33 was moved in the direction away from the apex 34 in the direction of the optical axis 18 from the focal point 33 and a point where a distance equivalent to 10% of the distance from the apex 34 of the curve of the second reflector 23B to the focal point 33 was moved in the direction away from the apex 34 in the direction of the optical axis 18 from the focal point 33 was set as the margin region 41, as illustrated in FIG. 10. The margin region 41 means a region having a margin with respect to the convergence of light and is a region in which the convergence and illuminance distribution of the light irradiated from the light emitting element 16 are excellent. Therefore, by deviating the position of the light emitting element 16 from the state illustrated in FIG. 10 to the state illustrated in FIG. 11 and disposing the light emitting element 16 in the margin region 41, it is possible to effectively prevent blurring (light diffusion) in which the irradiation pattern protrudes from the illumination target region 37 irradiated from the light emitting element 16 and the second reflector 23B positioned in the vicinity of the end portion of the light emitting element array.

As illustrated in FIG. 10, in the present embodiment, the distance from the apex 34 of the curve of the reflector 23 to the focal point 33 of the curve is 10 mm. Therefore, according to the definition of the margin region 41, a region between a point moved by a distance of 0.10 mm in the direction away from the second reflector 23B in the direction of the optical axis 18 from the focal point 33 and a point moved by a distance of 1.00 mm in the direction away from the second reflector 23B in the direction of the optical axis 18 from the focal point 33 is taken as the margin region 41 on the actual product.

On the other hand, a region positioned closer to the focal point 33 than the margin region 41 was set as a second focal region 42. The second focal region 42 is slightly deviated from the focal point 33, but is defined as a region having substantially no difference as compared with the case where the light emitting element 16 is disposed at the focal point 33. In addition, the margin region 41 is provided at a position farther away from the second reflector 23B than the second focal region 42.

The second focal region 42 is set as a region between a point where a distance equivalent to 0% or more and less than 1% of the distance from the apex 34 of the curve of the second reflector 23B to the focal point 33 is moved in the direction approaching the apex 34 in the direction of the optical axis 18 from the focal point 33 and a point where a distance equivalent to 0% or more and less than 1% of the distance from the apex 34 of the curve of the second reflector 23B to the focal point 33 is moved in the direction away from the apex 34 in the direction of the optical axis 18 from the focal point 33.

In the present embodiment, the distance from the apex 34 of the curve of the second reflector 23B to the focal point 33 is 10 mm. Therefore, according to the definition of the second focal region 42, a region between a point moved by a distance of less than 0.10 mm in the direction approaching the second reflector 23B in the direction along the optical axis 18 from the focal point 33 and a point moved by a distance of less than 0.10 mm in the direction away from the second reflector 23B in the direction along the optical axis 18 from the focal point 33 is taken as the second focal region 42 on the actual product. In the second reflector 23B and the light emitting element 16 corresponding to the second region 21B, the light emitting element 16 is not actually disposed in the second focal region 42.

A region in the vicinity of the focal point 33 of the curved surface of the first reflector 23A is set as a focal region 43 even in the light emitting element 16 and the first reflector 23A corresponding to the first region 21A. The focal region 43 is slightly deviated from the focal point 33, but is defined as a region having substantially no difference as compared with the case where the light emitting element 16 is disposed at the focal point 33. Since the light emitting element 16 and the first reflector 23A corresponding to the first region 21A are positioned at the center of the array of the light emitting elements 16 (the illumination unit 12), there will be no blurring in which the irradiation pattern protrudes from the illumination target region 37 to the light irradiated therefrom. Therefore, at the position corresponding to the first region 21A, the light emitting element 16 may be disposed at the focal point of the first reflector 23A, or the light emitting element 16 may be disposed in the focal region 43 in the vicinity of the focal point 33.

Since the focal region 43 is set almost similarly to the second focal region 42 illustrated in FIG. 10, the focal region 43 will be described as a representative in FIG. 10 (in this case, the actual individual optical axis 36 is parallel to the optical axis 18). The focal region 43 is a region between a point where a distance equivalent to 0% or more and less than 1% of the distance from the apex 34 of the curve of the first reflector 23A to the focal point 33 is moved in the direction approaching the apex 34 in the direction of the optical axis 18 from the focal point 33 and a point where a distance equivalent to 0% or more and less than 1% of the distance from the apex 34 of the curve of the first reflector 23A to the focal point 33 is moved in the direction away from the apex 34 in the direction of the optical axis 18 from the focal point 33.

In the present embodiment, the distance from the apex 34 of the curve of the first reflector 23A to the focal point 33 of the curve is 10 mm. Therefore, a region between a point moved by a distance of less than 0.10 mm in the direction approaching the first reflector 23A in the direction of the optical axis 18 from the focal point 33 and a point moved by a distance of less than 0.10 mm in the direction away from the first reflector 23A in the direction of the optical axis 18 from the focal point 33 is taken as the focal region 43 on the actual product.

Figure 12:
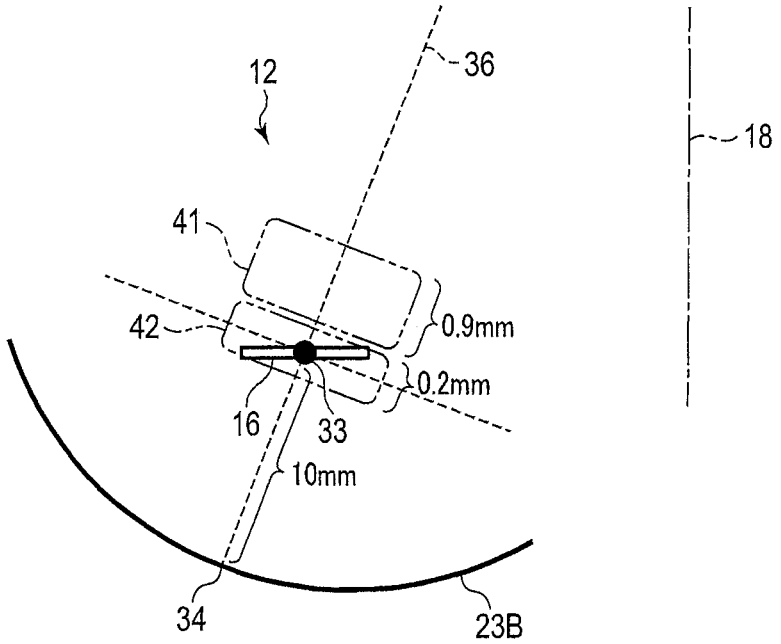
FIG. 12 is a schematic view illustrating a model of a light emitting element and a second reflector in the vicinity of an end portion of a light emitting element array according to a first modification, in which a margin region is set around a focal point from the results illustrated in FIGS. 8 and 9.
Figure 13:
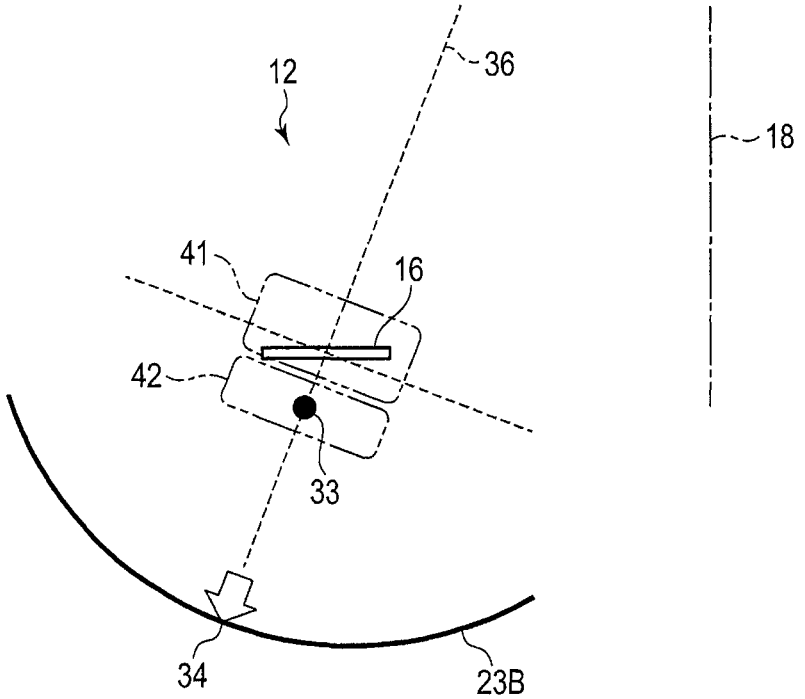
FIG. 13 is a schematic view illustrating a model of a light emitting element and a second reflector in the vicinity of an end portion of a light emitting element array according to the first modification, in which the position of the light emitting element is deviated in the individual optical axis direction of the light emitting element so as to arrange the light emitting element in the margin region of the schematic view illustrated in FIG. 12.

In the present embodiment, in view of the manufacturing cost and the like as described above, a region deviated by a predetermined distance from the focal point 33 is set as the margin region 41 and the second focal region 42 in the direction of the optical axis 18 of the entire illumination device 11, but a method of setting the margin region 41 and the second focal region 42 is not limited thereto. As illustrated in FIG. 12, it is obvious that the margin region 41 and the second focal region 42 may be set in the direction of the optical axis (individual optical axis 36) of the individual light emitting element 16. In the case of the modification (first modification), the margin region 41 was set as a region between a point where a distance equivalent to 1% of the distance from the apex 34 of the curve of the second reflector 23B to the focal point 33 was moved in the direction away from the apex 34 in the direction of the individual optical axis 36 from the focal point 33 and a point where a distance equivalent to 10% of the distance from the apex 34 of the curve of the second reflector 23B to the focal point 33 was moved in the direction away from the apex 34 in the direction of the individual optical axis 36 from the focal point 33. As illustrated in FIG. 13, by disposing the light emitting element 16 in the margin region 41, it is possible to effectively prevent blurring in which the irradiation pattern protrudes from the illumination target region 37 of the light irradiated from the light emitting element 16 and the second reflector 23B positioned in the vicinity of the end portion of the array of the light emitting element 16, as in the embodiment.

As illustrated in FIG. 12, in the first modification, the distance from the apex 34 of the curve of the second reflector 23B to the focal point 33 of the curve is 10 mm. Therefore, the margin region 41 is set as a region between a point moved by a distance of 0.10 mm in the direction away from the second reflector 23B in the direction of the individual optical axis 36 from the focal point 33 and a point moved by a distance of 1.00 mm in the direction away from the reflector 23 in the direction of the individual optical axis 36 from the focal point 33.

Similarly, in the first modification, the second focal region 42 is a region between a point where a distance equivalent to 0% or more and less than 1% of the distance from the apex 34 of the curve of the second reflector 23B to the focal point 33 is moved in the direction approaching the apex 34 in the direction of the individual optical axis 36 from the focal point 33 and a point where a distance equivalent to 0% or more and less than 1% of the distance from the apex 34 of the curve of the second reflector 23B to the focal point 33 is moved in the direction away from the apex 34 in the direction of the individual optical axis 36 from the focal point. In the first modification, the distance from the apex 34 of the curve of the second reflector 23B to the focal point 33 of the curve is 10 mm. Therefore, in the present modification, the second focal region 42 is set as region between a point moved by a distance of less than 0.10 mm in the direction approaching the second reflector 23B in the direction of the individual optical axis 36 from the focal point 33 and a point moved by a distance of less than 0.10 mm in the direction away from the second reflector 23B in the direction of the individual optical axis 36 from the focal point 33.

From the above, according to the present embodiment and the first modification, in order to improve the convergence of the light irradiated from the light emitting element 16 and the second reflector 23B positioned in the vicinity of the end portion of the array of the light emitting elements 16, the position of the light emitting element 16 may be deviated in the direction of the optical axis 18 of the illumination device 11, or the position of the light emitting element 16 may be deviated in the direction of the individual optical axis 36 of the individual light emitting element 16. Therefore, the "direction along the optical axis" in the present specification includes both the direction of the optical axis 18 of the illumination device 11 as a whole and the direction of the optical axis of each of the light emitting elements 16 (the direction of the individual optical axis 36) which is deviated by a predetermined angle from the direction of the optical axis 18, according to the first modification.

Figure 14:
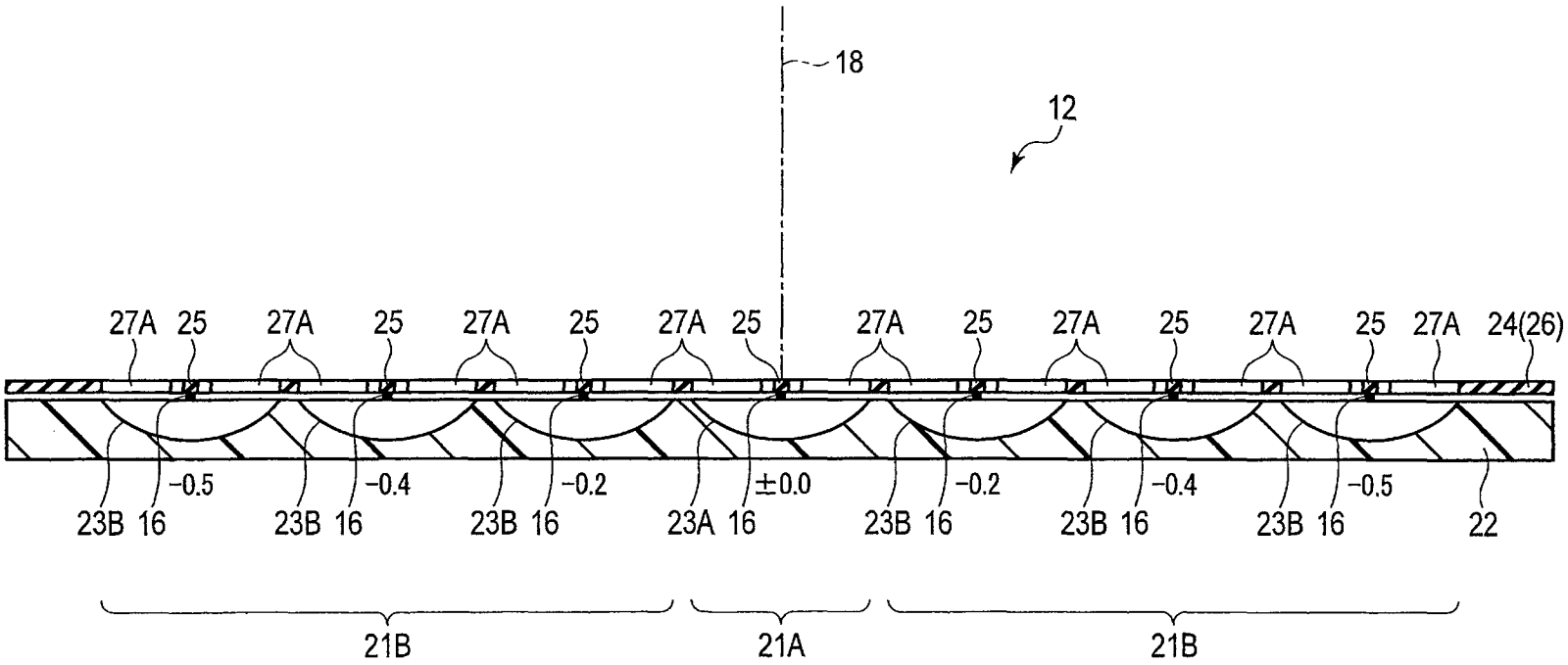
FIG. 14 is a cross-sectional view illustrating an illumination unit (a substrate, a light emitting element, and a mirror block) according to the first embodiment.

Subsequently, the actual illumination device 11 was manufactured according to the theoretical examination result described above. FIG. 14 illustrates a substrate 24, a light emitting element 16, and a mirror block 22 of an illumination unit 12 of the present embodiment. A first reflector 23A and a second reflector 23B formed in the mirror block 22 were formed in a positional relationship as illustrated in FIG. 14. In FIG. 14, the distance from the apex 34 of the curve of the second reflector 23B to the light emitting element 16 at the position corresponding to the second region 21B is set to be larger as going away from the central first region 21A of the illumination device 11 and approaching the end portion of the illumination unit 12 (array of light emitting elements 16). Therefore, the distance from the apex 34 of the curve of the second reflector 23B in the vicinity of the end portion of the illumination unit 12 to the corresponding light emitting element 16 is larger than the distance from the apex 34 of the curve of the second reflector 23B in the vicinity of the first region 21A to the corresponding light emitting element 16.

The first reflector 23A corresponding to the center (the first region 21A) of the illumination device 11 was formed so that the light emitting element 16 was positioned within the focal region 43 and the light emitting element 16 had a positional deviation amount of ±0.0 mm with respect to the focal point 33. This arrangement is an example, and the first reflector 23A corresponding to the first region 21A may be at any position as long as the position is within the range of the focal region 43 (within a range between a point moved by a distance of less than 0.10 mm in the direction approaching the first reflector 23A in the direction of the optical axis 18 from the focal point 33 and a point moved by a distance of less than 0.10 mm in the direction away from the first reflector 23A in the direction of the optical axis 18 from the focal point 33).

The second reflector 23B corresponding to the first region 21A side (in the vicinity of the first region 21A) of the second region 21B was formed so that the light emitting element 16 was positioned within the margin region 41 and the light emitting element 16 had a positional deviation amount of +0.2 mm with respect to the focal point 33. At this time, the apex 34 of the curve of the second reflector 23B is formed at a position that is lower by −0.2 mm than the apex 34 of the curve of the first reflector 23A. Therefore, the light emitting element 16 is disposed at a position deviated by +0.2 mm in the direction away from the second reflector 23B in the direction of the optical axis 18 from the focal point 33. The positional deviation amount of the light emitting element 16 with respect to the focal point 33 is an example, and any positional deviation amount may be used as long as the light emitting element 16 is within the margin region 41. In the second reflector 23B of the second region 21B on the first region 21A side, the positional deviation amount of the light emitting element 16 with respect to the focal point 33 may be, for example, +0.1 mm to +0.2 mm in the direction of the optical axis 18 from the focal point 33 or the direction away from the second reflector 23B in the direction of the individual optical axis 36.

The second reflector 23B corresponding to the center of the second region 21B was formed so that the light emitting element 16 was positioned within the margin region 41 and the light emitting element 16 had a positional deviation amount of +0.4 mm with respect to the focal point 33. At this time, the apex 34 of the curve of the second reflector 23B is formed at a position that is lower by −0.4 mm than the apex 34 of the curve of the first reflector 23A. Therefore, the light emitting element 16 is disposed at a position deviated by +0.4 mm in the direction away from the second reflector 23B in the direction of the optical axis 18 from the focal point 33. The positional deviation amount of the light emitting element 16 with respect to the focal point 33 is an example, and any positional deviation amount may be used as long as the light emitting element 16 is within the margin region 41. In the second reflector 23B corresponding to the center of the second region 21B, the positional deviation amount of the light emitting element 16 with respect to the focal point 33 may be, for example, +0.3 mm to +0.4 mm in the direction of the optical axis 18 from the focal point 33 or the direction away from the second reflector 23B in the direction of the individual optical axis 36.

The second reflector 23B corresponding to the end portion side (side away from the first region 21A) of the second region 21B was formed so that the light emitting element 16 was positioned within the margin region 41 and the light emitting element 16 had a positional deviation amount of +0.5 mm with respect to the focal point 33. At this time, the apex 34 of the curve of the second reflector 23B is formed at a position that is lower by −0.5 mm than the apex 34 of the curve of the first reflector 23A. Therefore, the light emitting element 16 is disposed at a position deviated by +0.5 mm in the direction away from the second reflector in the direction of the optical axis 18 from the focal point 33. The positional deviation amount of the light emitting element 16 with respect to the focal point 33 is an example, and any positional deviation amount may be used as long as the light emitting element 16 is within the margin region 41. In the second reflector 23B corresponding to the center of the second region 21B, the positional deviation amount of the light emitting element 16 with respect to the focal point 33 may be, for example, +0.5 mm to +1.0 mm in the direction of the optical axis 18 from the focal point 33 or the direction away from the second reflector 23B in the direction of the individual optical axis 36.

Subsequently, the evaluation result related to the cutoff characteristics of the illumination device 11 including the substrate 24, the light emitting element 16, and the mirror block 22 of the illumination unit 12 of the present embodiment, which is formed as illustrated in FIG. 14, will be described with reference to FIGS. 15 to 21.

Figure 15:
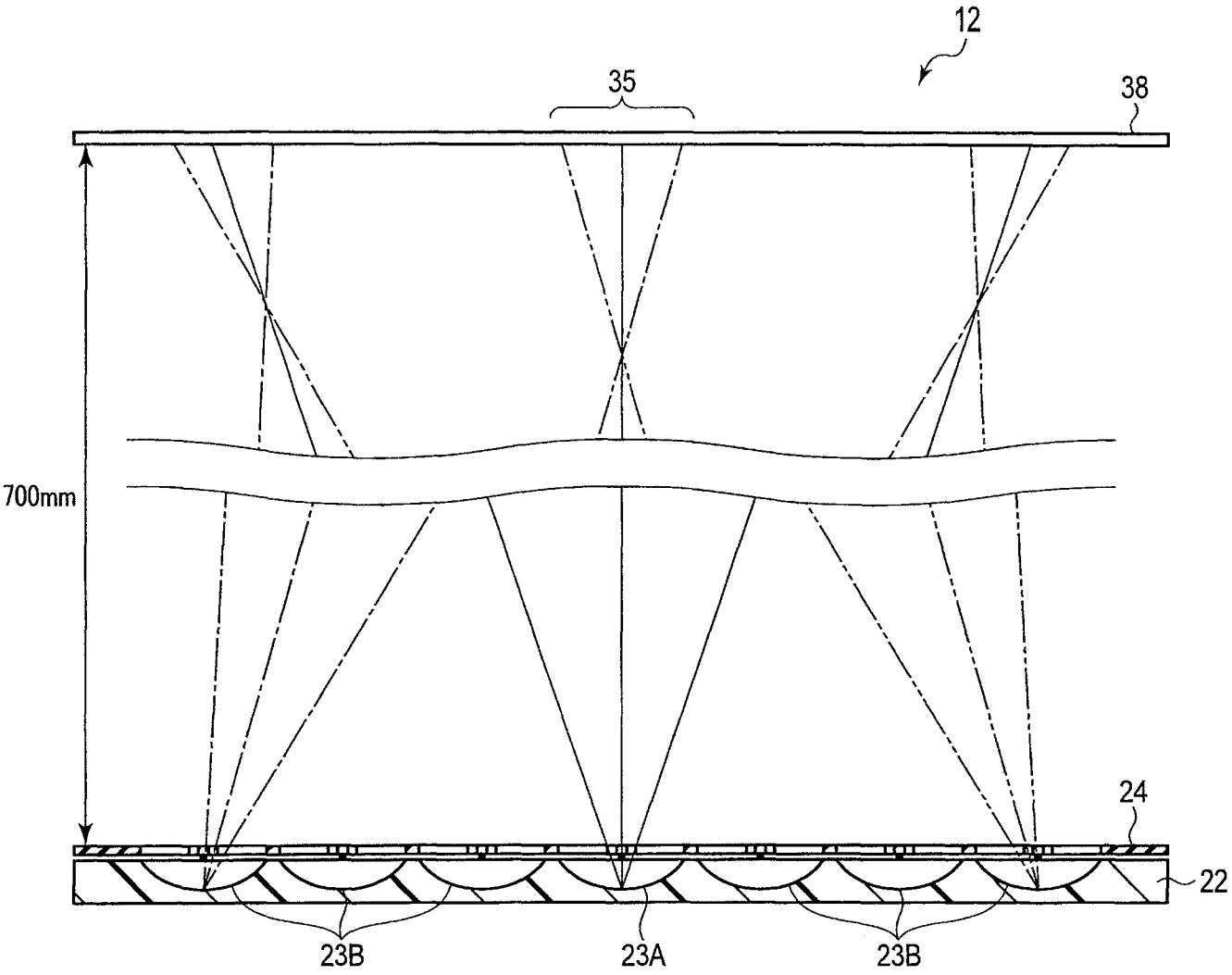

As illustrated in FIG. 15, a screen 38 (target) was set at a position (standard measurement position) separated by 700 mm from the light emitting element. The cutoff characteristics (difficulty in entering light to the patient's eyes) of the illumination device 11 was evaluated by examining the illuminance distribution of the light irradiated on the screen 38. FIG. 15 illustrates an aspect in which the second reflector 23B corresponding to the second region 21B is inclined (angular eccentricity) to the axis of the curve toward the end portion side (outer side), and the light irradiated from the light emitting element 16 and the second reflector 23B on the end portion side (outer side) is collected in the direction approaching the optical axis 18 of the entire illumination device 11. The light irradiated from the light emitting element 16 and the second reflector 23B corresponding to the second region 21B as described above is collected toward one region 35 on the optical axis 18, and spreads to a predetermined region around one region 35.

Figure 16:
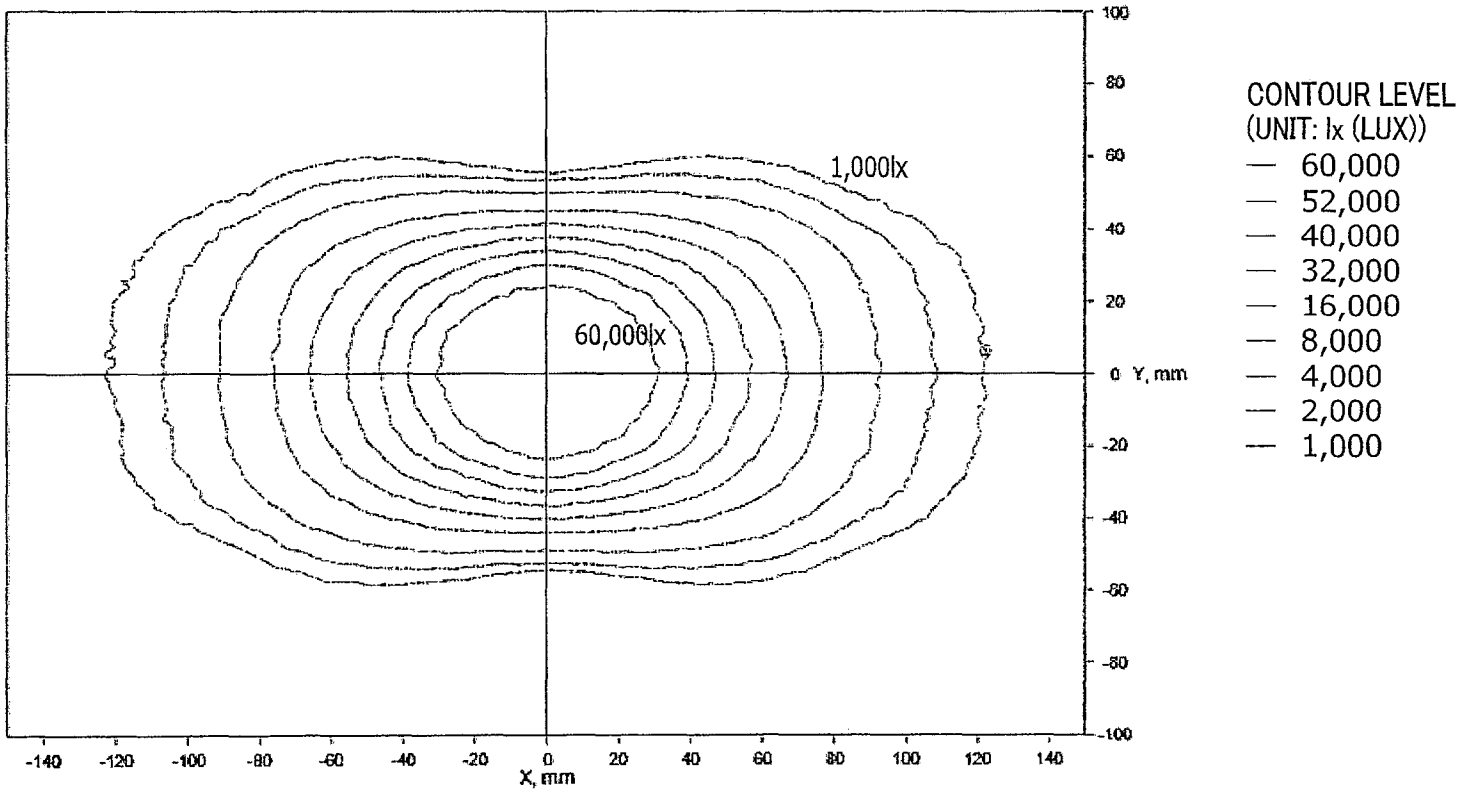
FIG. 16 is a view illustrating an illuminance distribution as a contour line by analyzing the illuminance distribution with a maximum value of 60,000 lux by using an illumination device of a reference example with the same positional relationship as the model illustrated in FIG. 15.
Figure 17:
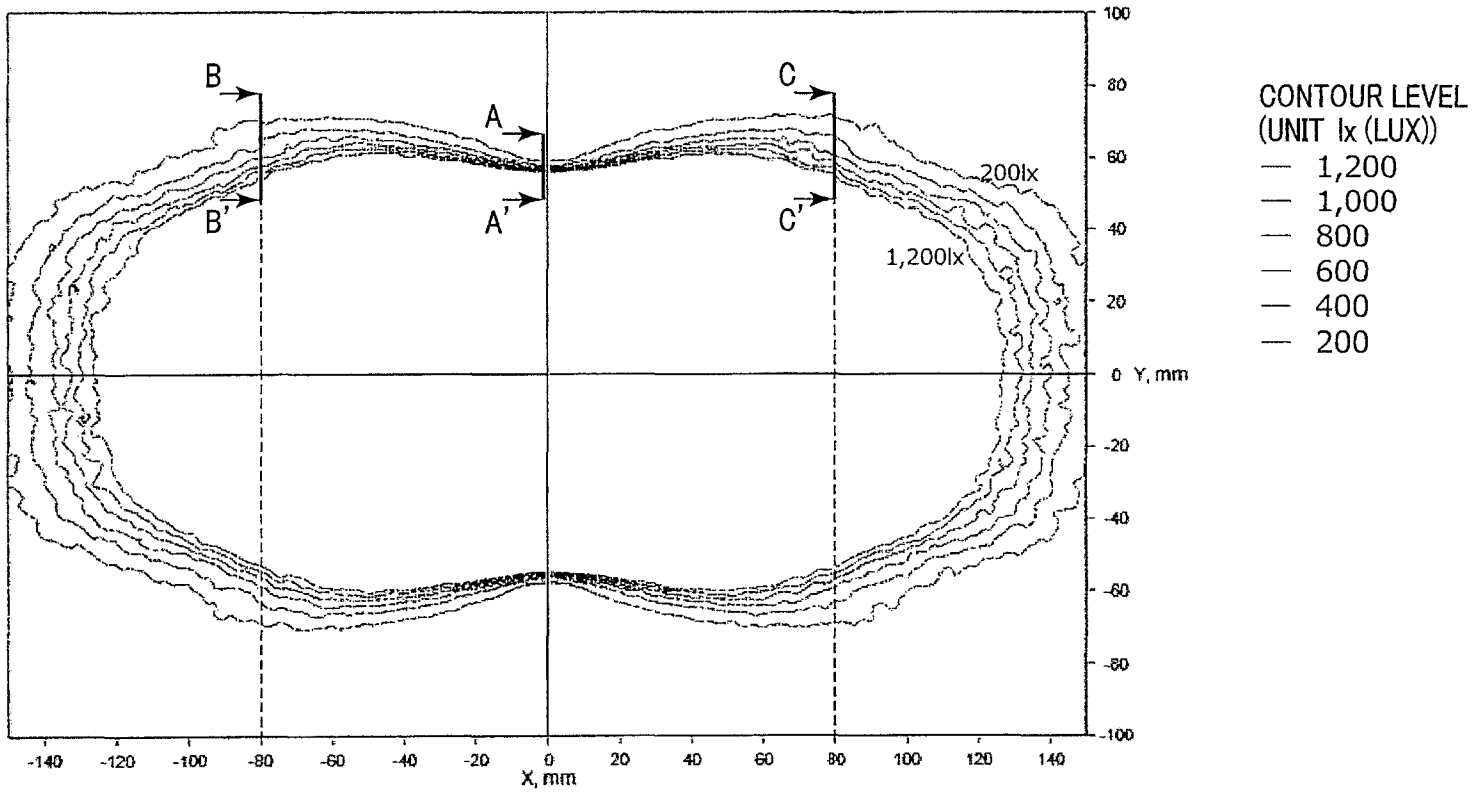
FIG. 17 is a view illustrating an illuminance distribution as a contour line by analyzing the illuminance distribution with a maximum value of 1,200 lux by using an illumination device of a reference example with the same positional relationship as the model illustrated in FIG. 15.

FIGS. 16 and 17 illustrate the results of irradiating the screen 38 with light by using the illumination device of the reference example. In the illumination device of the reference example, the light emitting element 16 corresponding thereto is disposed at the position of the focal point 33 of the curve of the first reflector 23A, and the light emitting element 16 corresponding thereto is disposed at the position of the focal point 33 of the curve of the second reflector 23B. Therefore, in the reference example, the position of the light emitting element 16 is not deviated in the direction along the optical axis 18 from the focal point 33 of the curve of the second reflector 23B (the light emitting element 16 is disposed within the margin region 41).

FIG. 16 illustrates the result when the illuminance distribution (contour) of the light irradiated from the illumination device of the reference example on the screen 38 was set to the maximum value of 60,000 lux (lx). According to the JIS standard, the maximum illuminance is determined to be 15,000 lux or more, but in practice, the maximum illuminance needs to be about 60,000 lux. The horizontal axis X represents the horizontal direction on the screen 38, and the vertical axis Y represents the vertical direction on the screen 38. From this drawing, it seems that there is no particular problem in the cutoff characteristics at first glance. FIG. 17 further illustrates the result when the illuminance distribution (contour) of the light irradiated from the illumination device of the present reference example on the screen 38 was displayed with only the low illuminance range with the maximum value being 1,200 lux. As a result, it was found that the illuminance distribution was disturbed at four corners of the illuminance distribution (position of B-B' line, position of C-C' line).

Figure 18:
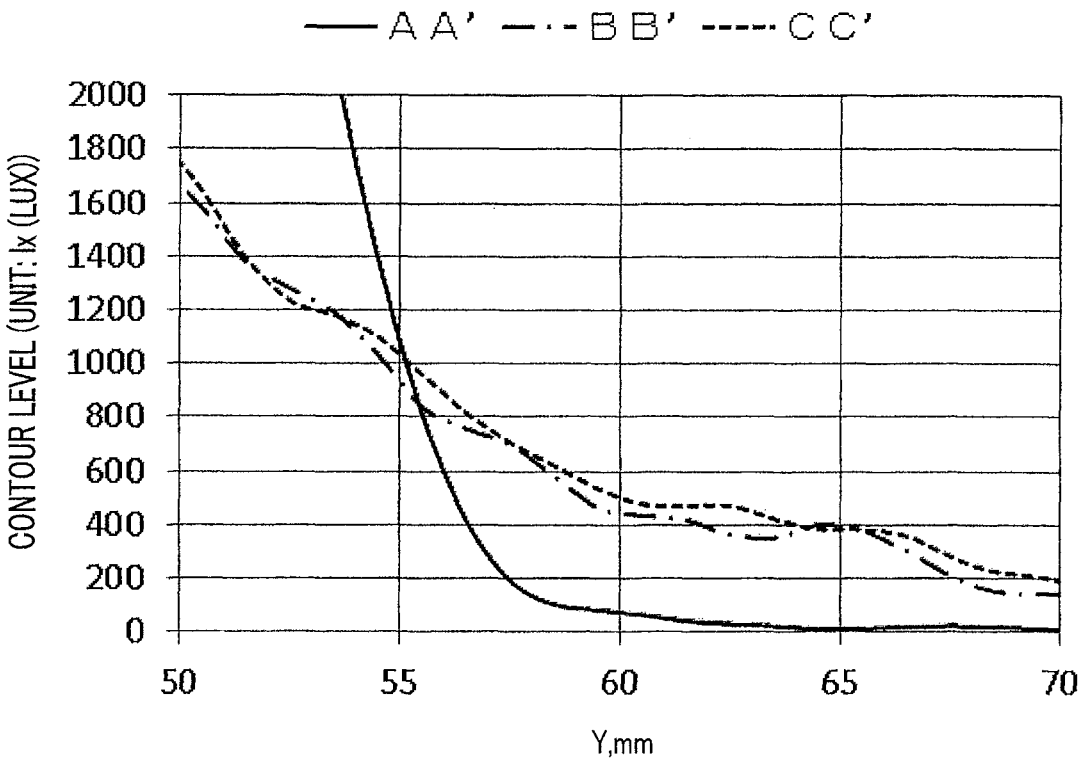
FIG. 18 is a view illustrating an A-A' cross section, a B-B' cross section, and a C-C' cross section illustrated in FIG. 17.

FIG. 18 illustrates an A-A' cross section, a B-B' cross section, and a C-C' cross section of the contour in FIG. 17. It was found from FIG. 18 that any of the A-A' cross section, the B-B' cross section, and the C-C' cross section satisfied the requirement of 1,200 lux or less, which was the reference value specified by the JIS standard (JIS T5753: 2012 dental illuminator), at a position 60 mm or more away from the center of light of the illumination device in the Y axis direction. However, as illustrated in the B-B' cross section and the C-C' cross section, the illuminance was maintained at around 500 lux at the position of 60 mm in the Y-axis direction from the center of the light emitted from the illumination device of the reference example. Therefore, the illumination device of the reference example has room for improvement in cutoff characteristics.

Figure 19:
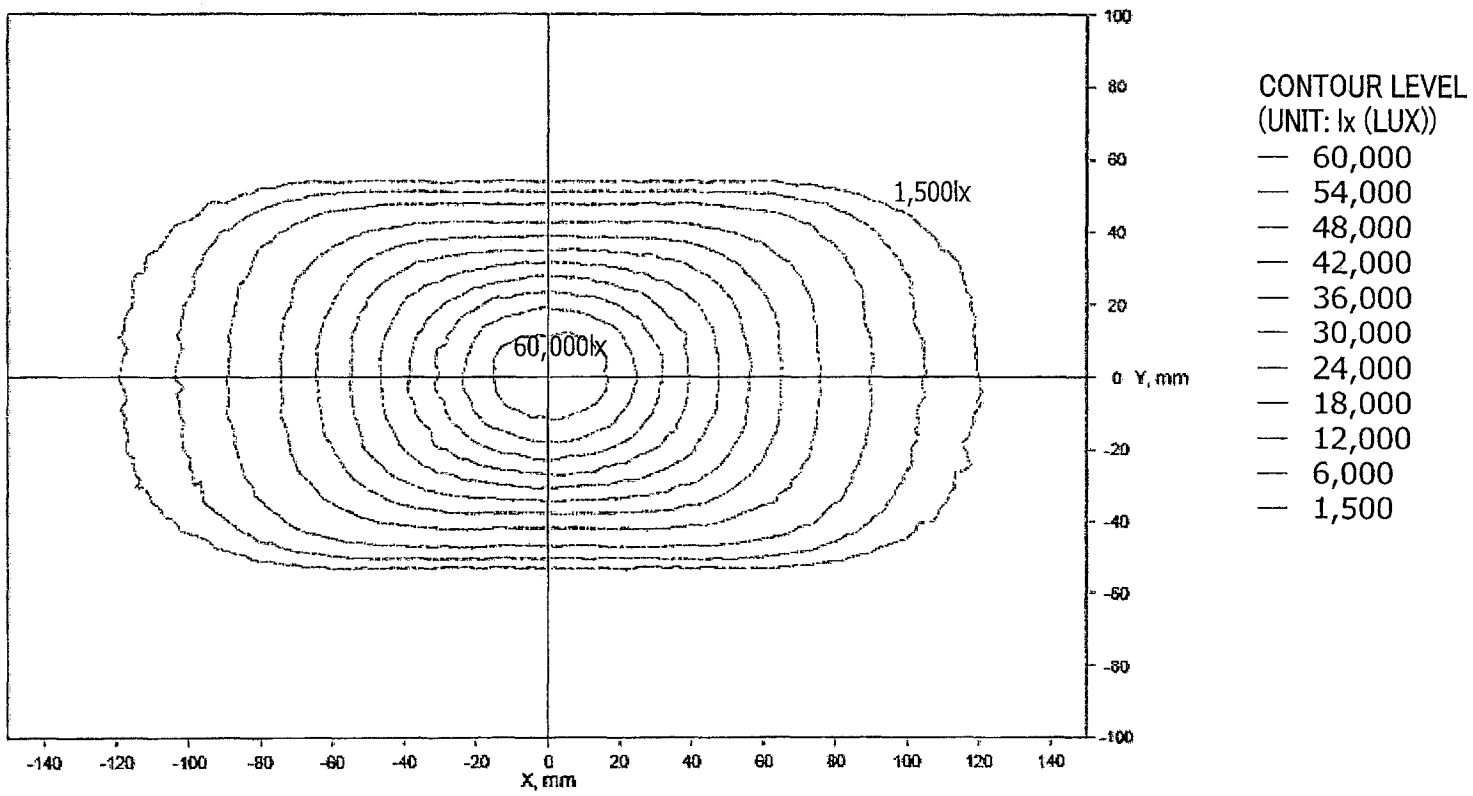
FIG. 19 is a view illustrating an illuminance distribution as a contour line by analyzing the illuminance distribution with a maximum value of 60,000 lux by using the model illustrated in FIG. 15 and using the illumination device of the embodiment arranged as illustrated in FIGS. 1 to 3 by adopting two illumination units illustrated in FIG. 14.
Figure 20:
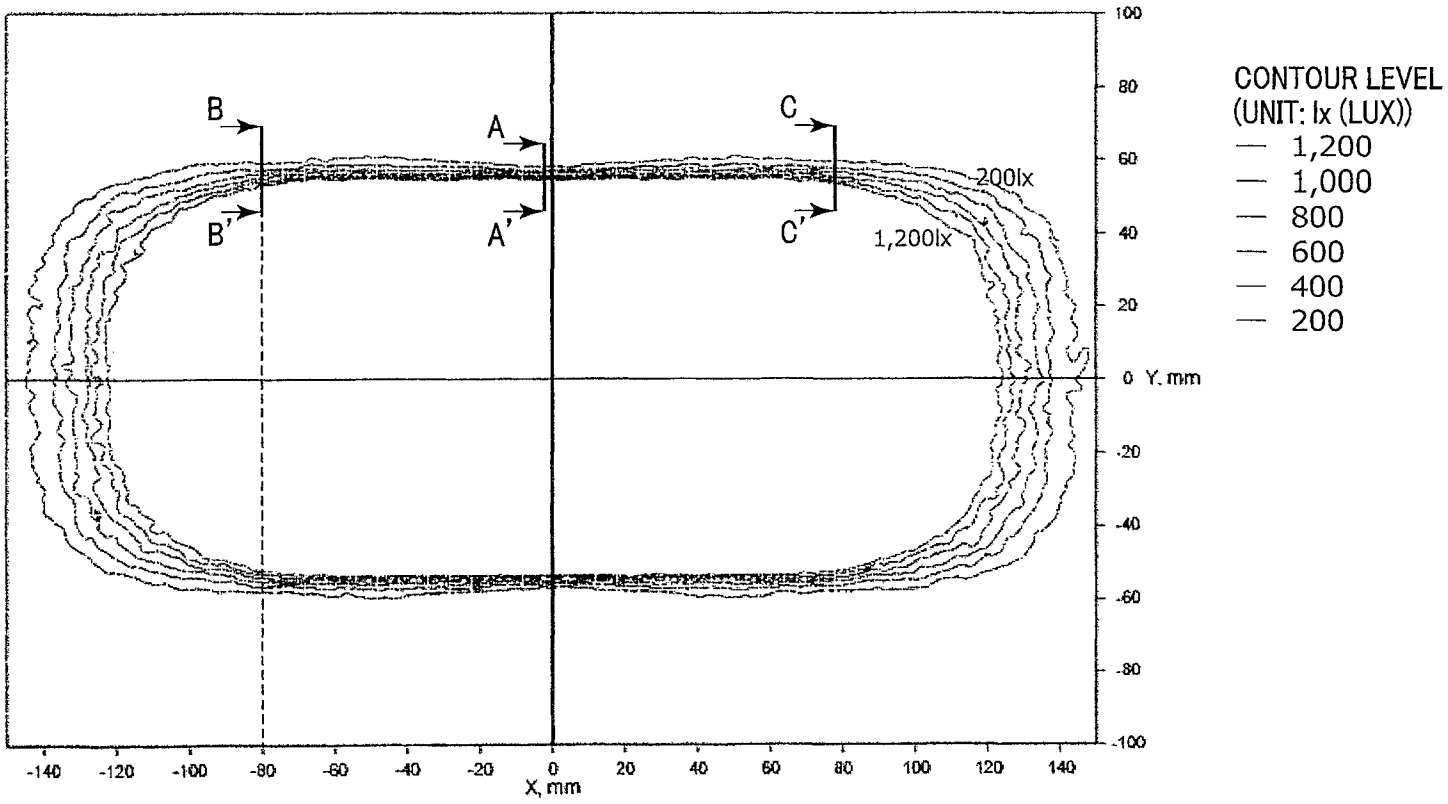
FIG. 20 is a view illustrating an illuminance distribution as a contour line by analyzing the illuminance distribution with a maximum value of 1,200 lux by using the model illustrated in FIG. 15 and using the illumination device of the embodiment arranged as illustrated in FIGS. 1 to 3 by adopting two illumination units illustrated in FIG. 14.

FIGS. 19 and 20 illustrate the result of irradiating the screen 38 with light by using the illumination device 11 of the present embodiment, that is, the illumination device 11 including the substrate 24, the light emitting element 16, and the mirror block 22 of the illumination unit 12 illustrated in FIG. 14.

FIG. 19 illustrates the result when the illuminance distribution (contour) of the light irradiated from the illumination device 11 of the present embodiment on the screen 38 was set to the maximum value of 60,000 lux (lx). The horizontal axis X represents the horizontal direction on the screen 38, and the vertical axis Y represents the vertical direction on the screen 38. Also in this drawing, as in the case of the above-described reference example, it seemed that there was no particular problem in the cutoff characteristics.

FIG. 20 further illustrates the result when the illuminance distribution (contour) of the light irradiated from the illumination device 11 of the present embodiment on the screen 38 was displayed with only the low illuminance range with the maximum value being 1,200 lux. As a result, it was found that there was no disturbance in the illuminance distribution even at the four corners of the illuminance distribution (position of B-B' line, position of C-C' line).

Figure 21:
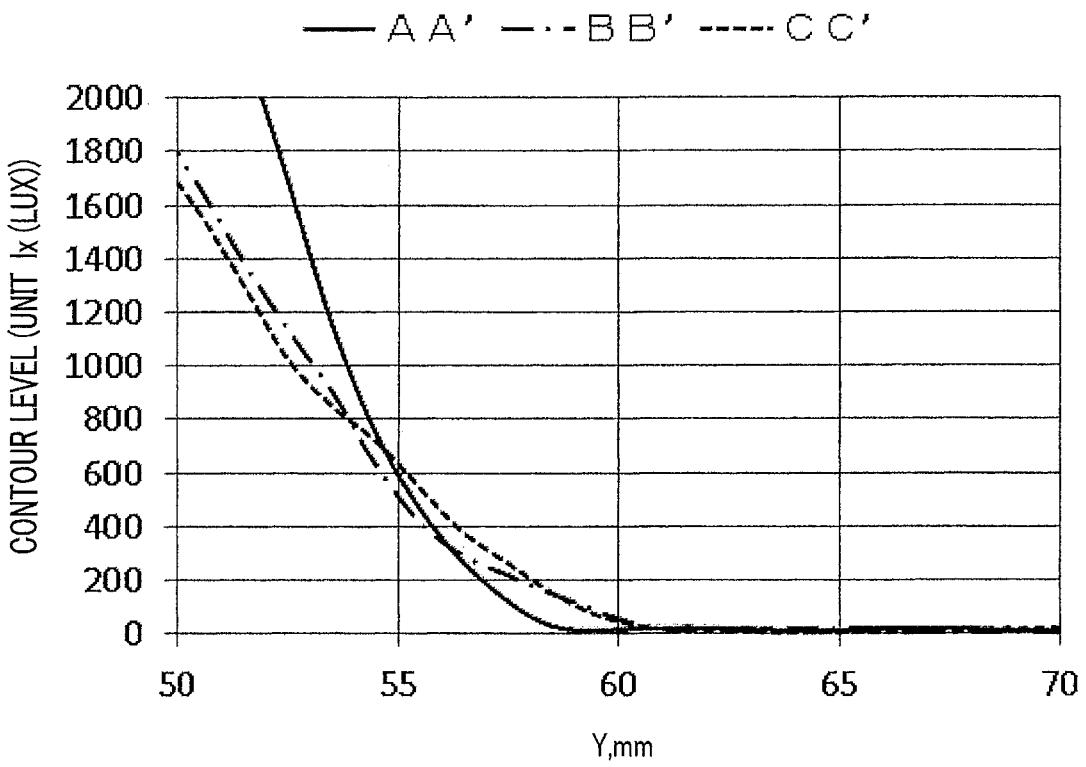
FIG. 21 is a view illustrating an A-A' cross section, a B-B' cross section, and a C-C' cross section illustrated in FIG. 20.

FIG. 21 illustrates an A-A' cross section, a B-B' cross section, and a C-C' cross section of the contour in FIG. 20. From FIG. 21, any of the A-A' cross section, the B-B' cross section, and the C-C' cross section satisfied the requirement of 1,200 lux or less, which was the reference value specified by the JIS standard (JIS T5753: 2012 dental illuminator), at a position 60 mm or more away from the center of light of the illumination device 11 in the Y axis direction. Further, as illustrated in the B-B' cross section and the C-C' cross section, the result of FIG. 21 showed that the illuminance was reduced to around 50 lux at the position of 60 mm in the Y axis direction from the center of the light, and the remarkable improvement in the cutoff characteristics was seen. Therefore, it was confirmed that the burden on the patient's eyes could be remarkably reduced by performing examination and treatment by using the illumination device 11 of the present embodiment.

According to the present embodiment, the following can be said. The illumination device 11 includes a plurality of light emitting elements 16 provided on a surface 21 intersecting with an optical axis, and a plurality of reflectors 23 provided so as to correspond to the plurality of light emitting elements 16, and each of the plurality of reflectors 23 includes a plurality of reflectors 23 having a curved cross section having at least one focal point 33. The plurality of reflectors 23 include: at least one first reflector 23A provided corresponding to a central first region 21A corresponding to the optical axis 18 on the surface 21 intersecting with the optical axis, each of the at least one first reflector 23A being providing so as to position one of the plurality of corresponding light emitting elements 16 within a focal region 43 in the vicinity of the focal point 33; and at least one second reflector 23B provided corresponding to a second region 21B positioned on the surface 21 intersecting with an optical axis deviated from the first region 21A in the direction intersecting with the optical axis 18, each of the at least one second reflector 23B having an angular eccentricity so as to collect light on one region 35 on the optical axis 18 and being provided so as to position within a margin region 41 in which one of the plurality of corresponding light emitting elements 16 is provided at a position away from each of the at least one second reflector 23B rather than the second focal region 42 in the vicinity of the focal point 33.

According to this configuration, by positioning the corresponding light emitting element 16 in the margin region 41 in the second reflector 23B corresponding to the second region 21B where blurring (light diffusion) in which the irradiation pattern protrudes from the illumination target region 37 easily occurs, it is possible to efficiently prevent disturbance of the illuminance distribution in which light enters the patient's eyes when the patient's mouth is irradiated with light. Due to this, it is possible to realize the ideal illumination device 11 in which the burden on the patient's eyes is reduced while securing sufficient illuminance so that the inside of the mouth can be illuminated brightly.

The at least one second reflector 23B includes one second reflector 23B positioned on the first region 21A side, and the other second reflector 23B provided at a position farther away from the first region 21A than the second reflector 23B. A distance from the apex 34 of the curve of the other second reflector 23B to one of the plurality of light emitting elements 16 corresponding to the other second reflector 23B is larger than a distance from the apex 34 of the curve of the one second reflector 23B to one of the plurality of light emitting elements 16 corresponding to the one second reflector 23B.

According to this configuration, it is possible to ensure a long distance between the apex 34 of the curved surface of the second reflector 23B and the light emitting element 16 as much as the second reflector 23B and the light emitting element 16 positioned farther from the so-called first region 21A. Due to this, the convergence (degree of convergence) of the light irradiated from the light emitting element 16 can be increased at a position away from the first region 21A where the irradiation pattern protrudes from the illumination target region 37, which is likely to cause blurring. Therefore, it is possible to more effectively prevent disturbance of the illuminance distribution caused by the light irradiated from the second reflector 23B and the light emitting element 16 positioned away from the first region 21A.

The margin region 41 is defined as a region between a point where a distance equivalent to 1% of the distance from the apex 34 of the curve to the focal point 33 is moved in the direction away from the apex 34 in the direction along the optical axis 18 from the focal point 33 and a point where a distance equivalent to 10% of the distance from the apex 34 of the curve to the focal point 33 is moved in the direction away from the apex 34 in the direction along the optical axis 18 from the focal point 33. According to this configuration, the range where the convergence of the light irradiated from the light emitting element 16 is the most excellent can be set as the margin region 41.

The focal region 43 and the second focal region 42 are defined as a region between a point where a distance equivalent to 0% or more and less than 1% of the distance from the apex 34 of the curve to the focal point 33 is moved in the direction approaching the apex 34 in the direction along the optical axis 18 from the focal point 33 and a point where a distance equivalent to 0% or more and less than 1% of the distance from the apex 34 of the curve to the focal point 33 is moved in the direction away from the apex 34 in the direction along the optical axis 18 from the focal point 33. According to this configuration, the position in the vicinity of the focal point 33 can be set as the focal region 43 and the second focal region 42.

The plurality of light emitting elements 16 are linearly disposed in the direction intersecting with the optical axis 18. In this way, when the light emitting elements 16 are linearly aligned, the distance from the central first region 21A becomes farther toward the end portion of the array of the light emitting elements 16. According to the above configuration, it is possible to efficiently prevent the blurring in which the irradiation pattern protrudes from the illumination target region 37 by the light irradiated from the second reflector 23B and the light emitting element 16 on the end portion side, thereby preventing disturbance of the illuminance distribution when the patient's mouth is irradiated with light.

Each of the plurality of light emitting elements 16 is an LED. According to this configuration, it is possible to provide the illumination device 11 with energy saving as the whole illumination by adopting an energy-saving LED as the light emitting element 16.

The illumination device 11 includes a substrate 24 provided so as to face a plurality of reflectors 23, a plurality of opening portions 27 provided in the substrate 24 so as to expose the plurality of reflectors 23, and a plurality of support portions 25 provided on the substrate 24, wherein each of the plurality of support portions 25 includes a plurality of support portions 25 positioned inside each of the plurality of opening portions 27 and supports each of the plurality of light emitting elements 16.

According to this configuration, a structure that supports the light emitting element 16 and also supplies power to the light emitting element 16 can be realized by the substrate 24. Therefore, it is possible to realize the illumination device 11 that can reduce the number of parts and can make the entire structure compact.

The plurality of light emitting elements 16 are provided on the surface sides of the plurality of support portions 25 that face the plurality of reflectors 23. According to this configuration, it is possible to realize the illumination device 11 that further reduces the burden on the patient, without the situation in which the light from the LED with higher brightness than the other light sources directly enter the patients' eyes.

Each of the plurality of support portions 25 provided at positions corresponding to the second region 21B is deviated in the direction away from the first region 21A with respect to each center of at least one second reflector 23B corresponding thereto. According to this configuration, the configuration in which the optical axis (individual optical axis 36) of the individual light emitting element 16 is inclined in the direction approaching the optical axis 18 of the entire illumination device 11 can be realized by a simple structure.

The magnitude of the positional deviation becomes larger as the distance from the first region 21A increases. According to this configuration, the configuration in which the inclination of the optical axis (individual optical axis 36) of the individual light emitting element 16 is increased as the distance from the first region 21A increases can be realized by a simple structure.

Figure 22:
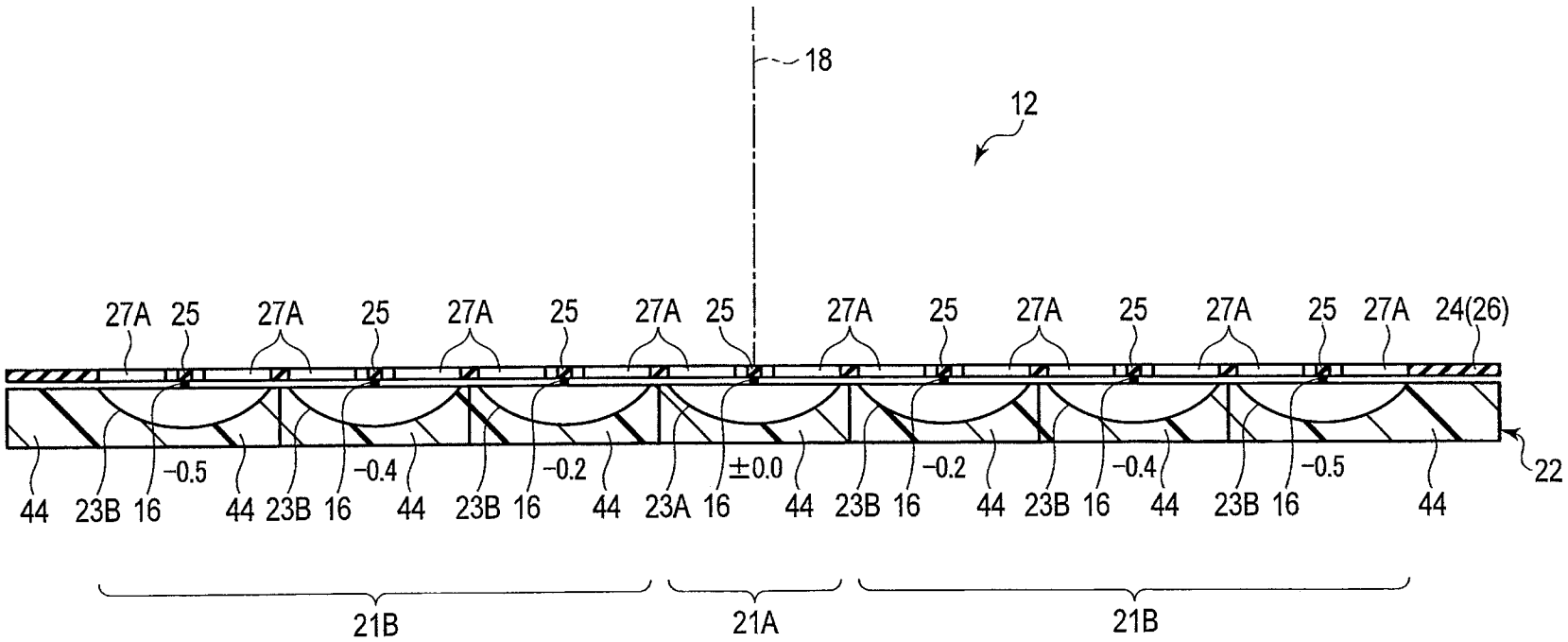
FIG. 22 is a cross-sectional view illustrating an illumination unit (a substrate, a light emitting element, and a mirror block) of an illumination device according to a second modification of the first embodiment.

Hereinafter, a modification of the illumination device 11 of the first embodiment will be described with reference to FIGS. 22 and 23. In the following modification, parts different from the first embodiment will be mainly described, and illustration and explanation of parts common to the first embodiment will be omitted.

Second Modification of First Embodiment

Subsequently, a second modification of the illumination device 11 of the first embodiment will be described with reference to FIG. 22. The illumination device 11 of the second modification is different from the illumination device 11 of the first embodiment in that a mirror block 22 is divided into each unit for each reflector 23.

In the present modification, the mirror block 22 is divided into individual blocks 44 corresponding to each reflector 23. Therefore, the distance between an apex 34 of a curve of a second reflector 23B and a focal point 33 can be freely changed. Therefore, for example, the position (height) of the individual block 44 can be finely adjusted by providing a position adjustment knob (screw) on a support body 13 of the illumination device 11. Therefore, the illumination device 11 of the present modification is particularly useful when it is desired to change the convergence (degree of convergence) of light according to the usage situation, and the like.

Third Modification of First Embodiment

Subsequently, a third modification of the illumination device 11 of the first embodiment will be described with reference to FIG. 23. The illumination device 11 of the third modification differs from the illumination device 11 of the first embodiment in that the distance between the apex 34 of the curve of the second reflector 23B and the corresponding light emitting element 16 is adjusted by changing the height of the surface of the substrate 24.

Figure 23:
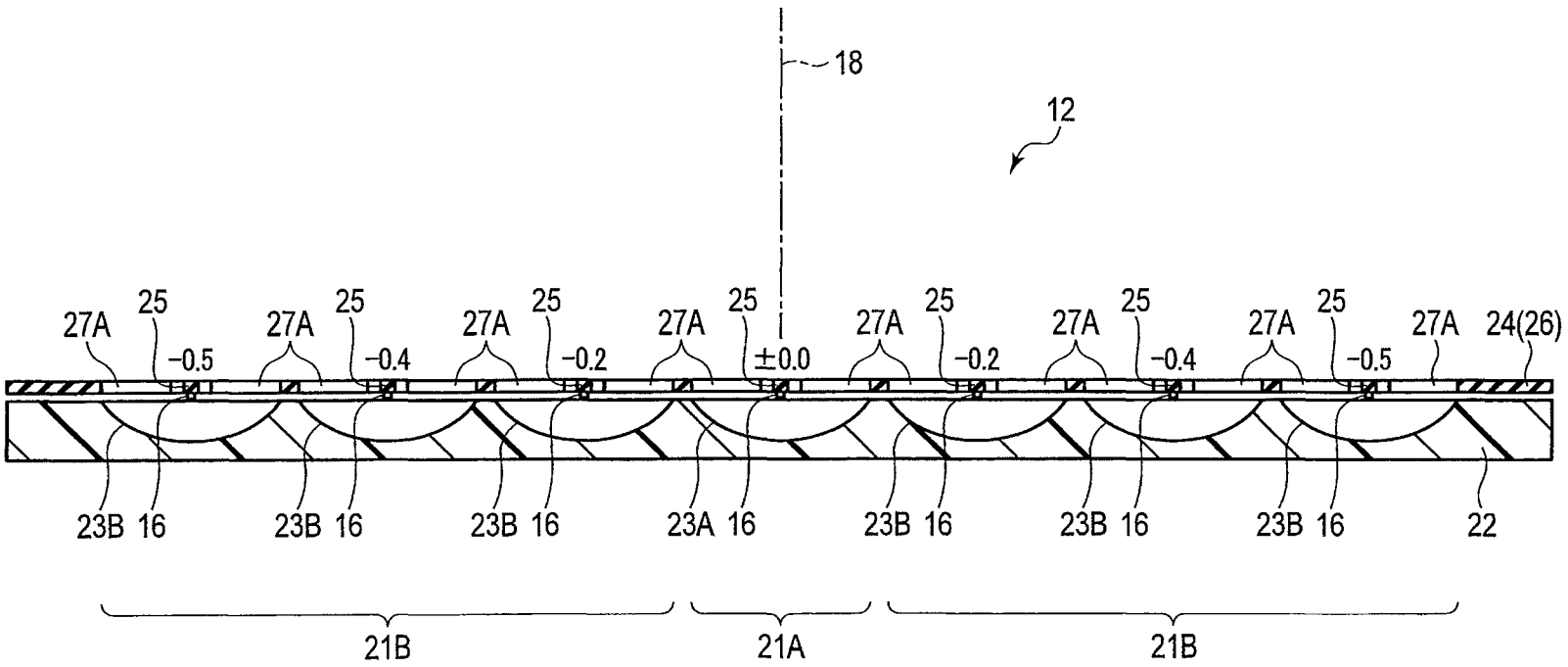
FIG. 23 is a cross-sectional view illustrating an illumination unit (a substrate, a light emitting element, and a mirror block) of an illumination device according to a third modification of the first embodiment.

In the present modification, as the distance from the first region 21A increases, the height of the surface of the substrate 24 on the side facing the reflector 23, that is, the position of the surface of the substrate 24 with respect to the direction of the optical axis 18 gradually decreases (in FIG. 23, the position of the surface of the substrate 24 is gradually shifted upward). Such a structure can be realized by, for example, the following method. The substrate 24 is constituted by a multilayer substrate and may be configured so that the number of layers constituting the substrate 24 gradually decreases as the distance from the first region 21A increases, and the thickness thereof gradually decreases. Alternatively, the substrate 24 may be formed as one stepped substrate by bonding a plurality of substrates in a stepwise fashion while electrically connecting the plurality of substrates, and the height of the surface of the substrate 24 may be gradually lowered.

In the present modification, the first reflector 23A corresponding to the center (the first region 21A) of the illumination device 11 was formed so that the light emitting element 16 was positioned within the focal region 43 and the light emitting element 16 was formed so as to have a positional deviation amount of ±0.0 mm with respect to the focal point 33. This arrangement is an example, and the first reflector 23A corresponding to the first region 21A may be at any position as long as the position is within the range of the focal region 43 (within a range between a point moved by a distance of less than 0.10 mm in the direction approaching the first reflector 23A in the direction of the optical axis 18 from the focal point 33 and a point moved by a distance of less than 0.10 mm in the direction away from the first reflector 23A in the direction of the optical axis 18 from the focal point 33 or in the direction of the individual optical axis 36).

The second reflector 23B corresponding to the first region 21A side (in the vicinity of the first region 21A) of the second region 21B was formed so that the light emitting element 16 was positioned within the margin region 41 and the light emitting element 16 had a positional deviation amount of +0.2 mm with respect to the focal point 33. At this time, the light emitting element 16 corresponding to the second reflector 23B was disposed at a position 0.2 mm lower than the height of the light emitting element 16 corresponding to the first reflector 23A (in FIG. 23, the position 0.2 mm above the light emitting element 16 corresponding to the first reflector 23A). Therefore, the light emitting element 16 is disposed at a position deviated by +0.2 mm in the direction away from the second reflector 23B in the direction of the optical axis 18 from the focal point 33. The positional deviation amount of the second reflector 23B corresponding to the first region 21A side of the second region 21B is an example, and the same positional deviation amount as in the first embodiment can be obtained.

The second reflector 23B corresponding to the center of the second region 21B was formed so that the light emitting element 16 was positioned within the margin region 41 and the light emitting element 16 had a positional deviation amount of +0.4 mm with respect to the focal point 33. At this time, the light emitting element 16 corresponding to the second reflector 23B was disposed at a position 0.4 mm lower than the height of the light emitting element 16 corresponding to the first reflector 23A (in FIG. 23, the position 0.4 mm above the light emitting element 16 corresponding to the first reflector 23A). Therefore, the light emitting element 16 is disposed at a position deviated by +0.4 mm in the direction away from the second reflector 23B in the direction of the optical axis 18 from the focal point 33. The positional deviation amount of the second reflector 23B corresponding to the center of the second region 21B is an example, and the same positional deviation amount as in the first embodiment can be obtained.

The second reflector 23B corresponding to the end portion side (side away from the first region 21A) of the second region 21B was formed so that the light emitting element 16 was positioned within the margin region 41 and the light emitting element 16 had a positional deviation amount of +0.5 mm with respect to the focal point 33. At this time, the light emitting element 16 corresponding to the second reflector 23B was disposed at a position 0.5 mm lower than the height of the light emitting element 16 corresponding to the first reflector 23A (in FIG. 23, the position 0.5 mm above the light emitting element 16 corresponding to the first reflector 23A). Therefore, the light emitting element 16 is disposed at a position deviated by +0.5 mm in the direction away from the second reflector 23B in the direction of the optical axis 18 from the focal point 33. The positional deviation amount of the second reflector 23B corresponding to the end portion side of the second region 21B is an example, and the same positional deviation amount as in the first embodiment can be obtained.

The same operations and effects as those of the first embodiment can also be exerted by the illumination device 11 of the present modification.

Second Embodiment

Figure 24:
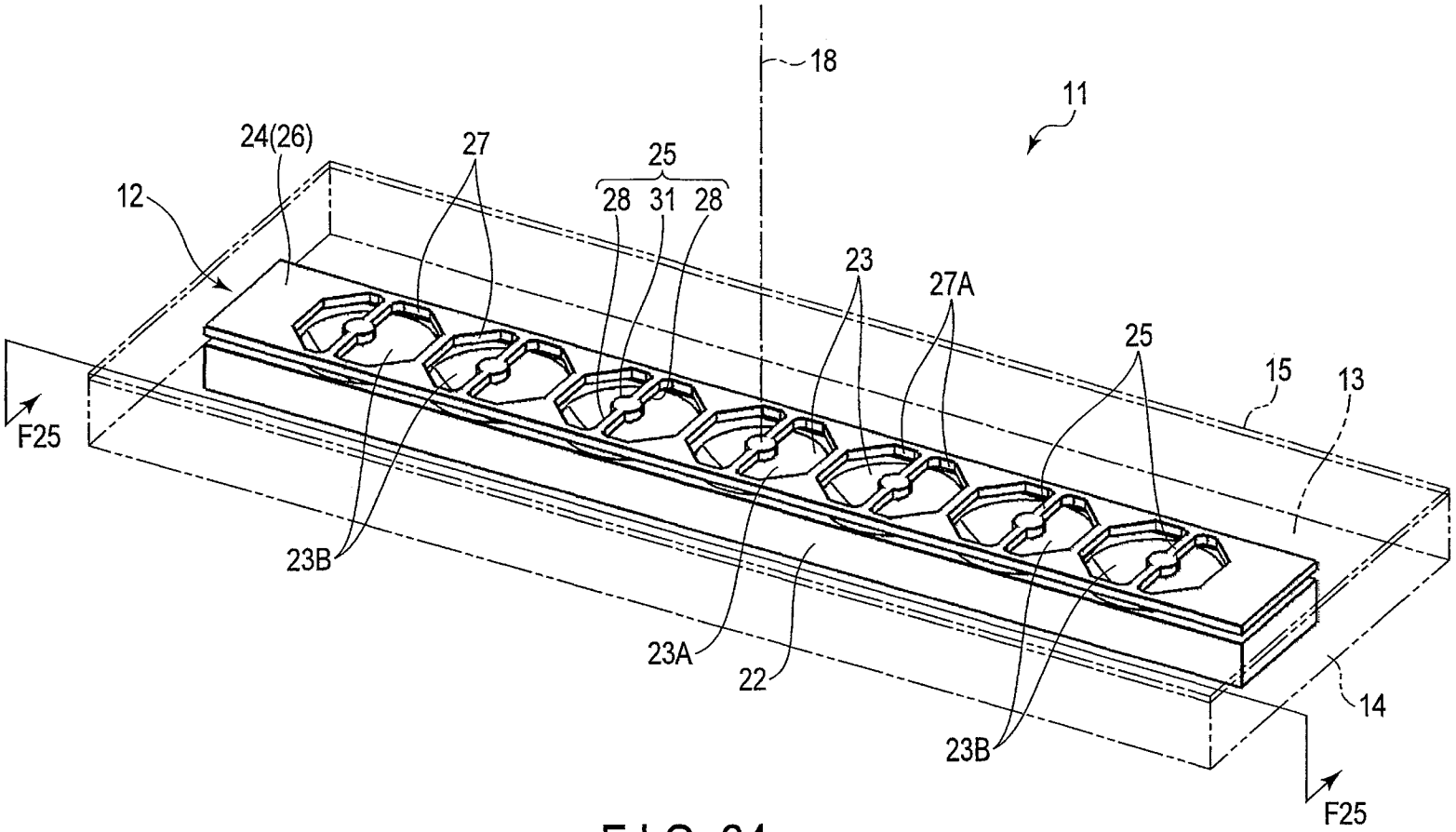
FIG. 24 is a perspective view illustrating an illumination device according to a second embodiment.
Figure 25:
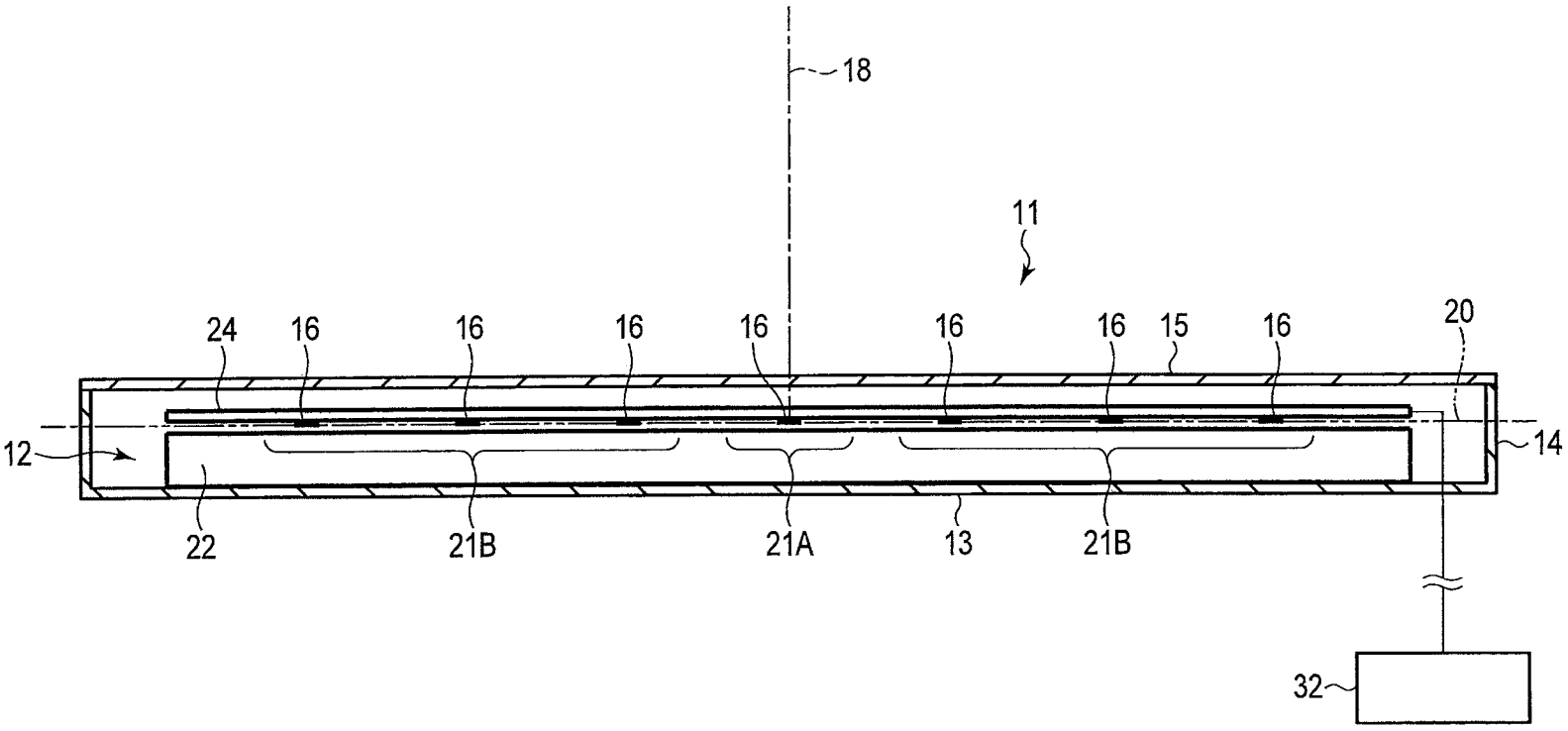
FIG. 25 is a cross-sectional view illustrating the interior of the illumination device by cutting a support body, a lamp shade portion, and a cover along line F25-F25 illustrated in FIG. 24.

Hereinafter, an illumination device 11 of a second embodiment will be described with reference to FIGS. 24 and 25. The second embodiment differs from the first embodiment in that the illumination unit 12 is constituted by one illumination unit. Hereinafter, parts different from those of the first embodiment will be mainly described, and the illustration and explanation of parts common to those of the first embodiment will be omitted.

The illumination device 11 includes a support body 13, a lamp shade portion 14 provided in a frame shape so as to be continuous with the support body 13, a transmissive cover 15 provided so as to cover a distal end portion of the lamp shade portion 14 (end portion on the opposite side to an end portion on the support body 13 side), and one illumination unit 12 (array of light emitting elements 16) fixed to the support body 13. The support body 13 is supported by an arm or the like. For example, the support body 13 can be supported at a predetermined position and angle through the arm so as to face a patient. An optical axis 18 (illumination optical axis) of the illumination device 11 as a whole is defined by a set of light irradiated from a plurality of light emitting elements 16 described later. The optical axis 18 (illumination optical axis) passes through the central portion of the support body 13 and coincides with the central axis that intersects (orthogonally) with the support body 13.

Further, a surface 21 intersecting with the optical axis can be defined in the illumination device 11. As an example of the surface 21 intersecting with the optical axis, a surface orthogonal to the optical axis 18 can be mentioned, but is not limited thereto. Another example of the surface 21 intersecting with the optical axis may be a surface substantially orthogonal to the optical axis 18.

The surface 21 intersecting with the optical axis has a first region 21A at the center corresponding to the optical axis 18 and a second region 21B deviating from the first region 21A in a direction intersecting with the optical axis 18. In the present embodiment, an example of the direction intersecting with the optical axis 18 is a horizontal direction (lateral direction), but the present embodiment is not limited thereto. For example, the direction intersecting with the optical axis 18 may be a vertical direction (longitudinal direction).

The configuration of the illumination unit 12 is the same as that in the first embodiment. The plurality of light emitting elements 16 are linearly provided at substantially constant intervals on the surface 21 intersecting with the optical axis in the direction intersecting with the optical axis 18.

According to the present embodiment, it is possible to exert substantially the same operations and effects as those of the first embodiment. In the present embodiment, the illuminance of the illumination device 11 is reduced by the small number of the light emitting elements 16, but for example, in addition to the illumination device 11 of the first embodiment, it is particularly useful in the case where it is desired to provide a low-cost low-price illumination device 11 as another product lineup.

While certain embodiments have been described, these embodiments have been presented by way of example only and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and sprit of the inventions.

What is claimed is:

1. An illumination device comprising:

a plurality of light emitting elements provided on a surface intersecting with an optical axis; and a plurality of reflectors provided so as to correspond to the plurality of light emitting elements, each of the plurality of reflection surfaces having a curved cross section with at least one focal point, wherein the plurality of reflectors comprises:

at least one first reflector provided corresponding to a central first region corresponding to the optical axis on the surface intersecting with the optical axis, the at least one first reflector being provided so that the plurality of corresponding light emitting elements are positioned within a focal region in a vicinity of the focal point; and at least one second reflector provided corresponding to a second region positioned on the surface intersecting with the optical axis that is deviated from the first region in a direction intersecting with the optical axis, the at least one second reflector having an angular eccentricity so as to collect light on one region on the optical axis and being provided so as to be positioned within a margin region in which the plurality of corresponding light emitting elements are provided at positions farther away than a second focal region in a vicinity of the focal point.

2. The illumination device according to claim 1, wherein the at least one second reflector comprises:

one second reflector positioned on the first region side; and another second reflector provided at a position farther away from the first region than the one second reflector, wherein a distance from an apex of a curve of said another second reflector to one of the plurality of light emitting elements corresponding to said another second reflector is larger than a distance from an apex of a curve of the one second reflector to one of the plurality of light emitting elements corresponding to the one second reflector.

3. The illumination device according to claim 2, wherein the margin region is defined as a region between a point where a distance equivalent to 1% of the distance from the apex of the curve to the focal point is moved in a direction away from the apex in a direction along the optical axis from the focal point and a point where a distance equivalent to 10% of the distance from the apex of the curve to the focal point is moved in a direction away from the apex in a direction along the optical axis from the focal point.

4. The illumination device according to claim 1, wherein the focal region and the second focal region are defined as a region between a point where a distance equivalent to 0% or more and less than 1% of a distance from an apex of a curve to the focal point is moved in a direction approaching the apex in a direction along the optical axis from the focal point and a point where a distance equivalent to 0% or more and less 1% of the distance from the apex of the curve to the focal point is moved in a direction away from the apex in a direction along the optical axis from the focal point.

5. The illumination device according to claim 1, wherein the plurality of light emitting elements are linearly disposed in a direction intersecting with the optical axis.

6. The illumination device according to claim 1, wherein the curve is a quadratic curve.

7. The illumination device according to claim 1, wherein each of the plurality of light emitting elements is an LED.

8. The illumination device according to claim 7, comprising:

a substrate provided so as to face the plurality of reflectors;

a plurality of opening portions provided in the substrate so as to expose the plurality of reflectors; and a plurality of support portions provided on the substrate, each of the plurality of support portions being positioned inside each of the plurality of opening portions and supporting each of the plurality of light emitting elements.

9. The illumination device according to claim 8, wherein the plurality of light emitting elements are provided on a surface side of the plurality of support portions that faces the plurality of reflectors.

10. The illumination device according to claim 8, wherein each of the plurality of support portions provided at positions corresponding to the second region is deviated in a direction away from the first region with respect to each center of the at least one second reflector corresponding thereto.

11. The illumination device according to claim 10, wherein magnitude of the positional deviation becomes larger as a distance from the first region increases.

* * * * *